United States Patent [19]

Ishizaka et al.

[11] Patent Number: 4,872,320

[45] Date of Patent: Oct. 10, 1989

[54] REFRIGERATION SHOWCASE

[75] Inventors: Yoshirou Ishizaka, Ora; Hiroshi Naganuma, Oizumi; Kenji Sato; Yuji Kishi, both of Ohta; Yoshihisa Ishida; Kiyokazu Goto, both of Oizumi, all of Japan

[73] Assignee: Sanyo Electric Co., Ltd., Osaka, Japan

[21] Appl. No.: 281,268

[22] Filed: Dec. 7, 1988

[30] Foreign Application Priority Data

| | | | |
|---|---|---|---|
| Dec. 11, 1987 | [JP] | Japan | 62-314982 |
| Feb. 3, 1988 | [JP] | Japan | 63-24585 |
| Apr. 7, 1988 | [JP] | Japan | 63-86821 |
| Apr. 20, 1988 | [JP] | Japan | 63-97310 |
| May 26, 1988 | [JP] | Japan | 63-129060 |
| Jun. 7, 1988 | [JP] | Japan | 63-140183 |

[51] Int. Cl.[4] ..... A47F 3/04

[52] U.S. Cl. ..... 62/255; 62/237; 62/448

[58] Field of Search ..... 62/255, 248, 249, 251, 62/246, 237, 448

[56] References Cited

U.S. PATENT DOCUMENTS

| | | | |
|---|---|---|---|
| 1,462,285 | 7/1923 | Hilger | 62/255 X |
| 1,907,680 | 5/1933 | Strass | 62/255 |
| 2,257,948 | 10/1941 | Green | 62/255 X |
| 2,915,884 | 12/1959 | Haushalter et al. | 62/237 X |
| 4,019,339 | 4/1977 | Anderson | 62/255 |
| 4,572,598 | 2/1986 | Moore, Jr. | 62/246 X |
| 4,632,019 | 12/1986 | Whiteman | 62/237 X |

*Primary Examiner*—William E. Tapolcai
*Attorney, Agent, or Firm*—Darby & Darby

[57] ABSTRACT

A refrigeration showcase comprising a display case, a machine case and an air duct connecting the display case to the machine case, the display case comprising a display table for displaying commodities as placed thereon, a cover member openably covering the display table from above to define a commodity chamber above the display table and permitting the commodity chamber to be seen therethrough from outside, and an air passage member disposed under the display table and providing a cold air supply portion for supplying cold air therethrough to the commodity chamber and a cold air discharge portion independent of the supply portion for discharging cold air from the commodity chamber therethrough, the machine case comprising a case body, a refrigerator housed in the case body and providing a refrigeration cycle and a cold air circulating blower for supplying air cooled by the evaporator in circulation, the air duct having a forward air channel for transporting the cold air, and a return air channel independent of the forward air channel.

24 Claims, 27 Drawing Sheets

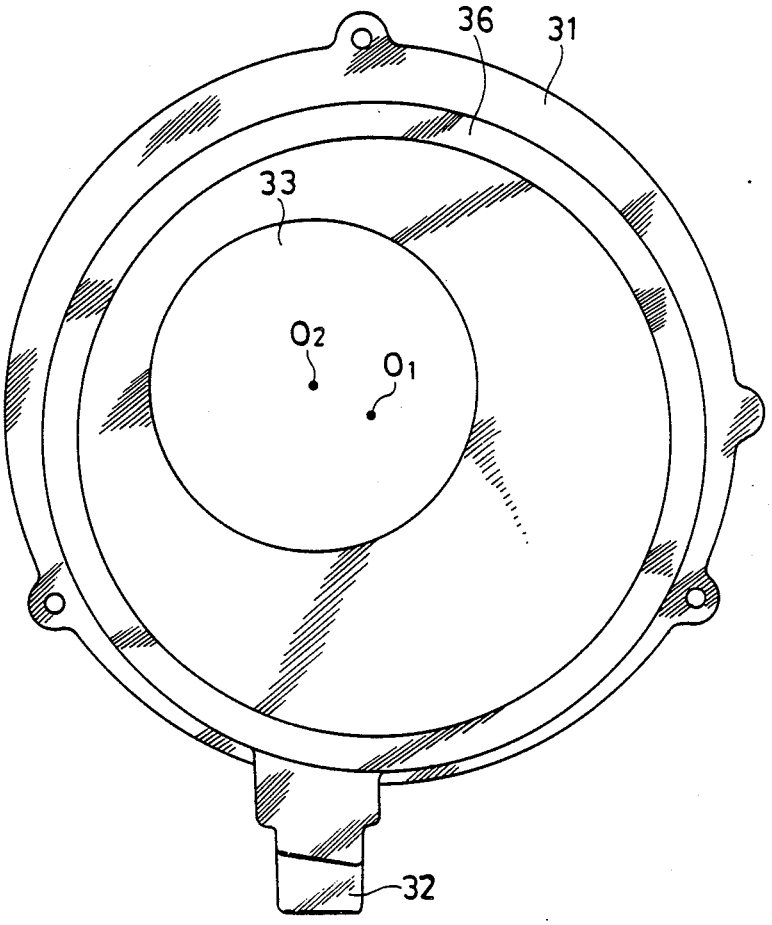
36
31
33
O2
O1
32

REFRIGERATION SHOWCASE

BACKGROUND OF THE INVENTION

1. Field of the Invention

The present invention relates to refrigeration showcases, and more particularly to a refrigeration showcase comprising a display case for displaying commodities while refrigerating the commodities and a machine case for supplying cold air to the display case in circulation.

2. Description of the Prior Art

Examined Japanese Patent Publication No. SHO 55-17308 discloses a showcase which comprises a display case and a machine case separate from the display case and housing mechanical components such as a refrigerator and a cold air circulating blower for supplying the air cooled in the machine case to the display case through a heat insulation duct.

The disclosed display case is open at its front side and has various ingenious means for preventing transfer of heat to the commodity accommodating portion of the display case through the front opening. There are many differences between the open refrigeration showcase and the closed refrigeration showcase in the construction of the commodity accommodating portion, method of recognizing commodities and arrangement of illumination means, so that the ingenious means are not usable as they are for the closed refrigeration showcase while fully assuring the advantages of the separate construction.

On the other hand, a refrigeration showcase is known which is in the form of a columnar assembly comprising such a closed refrigeration showcase for displaying commodities while refrigerating the commodities, and a machine chamber rotatably supporting the display case thereabove for supplying cold air to the display case in circulation (see Unexamined Japanese Utility Model Publication No. SHO 49-85662). However, since the machine chamber which has a refrigeration cycle and is therefore invariably heavy is assembled with display case the known device can be installed only at locations where. sufficient mechanical strength is available.

SUMMARY OF THE INVENTION

The present invention provides a refrigeration showcase which comprises a display case for displaying commodities while refrigerating the commodities, a machine case disposed at a position away from the display case, and an air duct connecting the display case to machine case in communication therewith, the display case comprising a display table for displaying the commodities as placed thereon, a cover member openably covering the display table from above to define a commodity chamber above the display table and permitting the commodity chamber to be seen therethrough from outside, and an air passage member disposed under the display table and providing a cold air supply portion for supplying cold air therethrough to the commodity chamber and a cold air discharge portion independent of the supply portion for discharging cold air from the commodity chamber therethrough, the machine case comprising a case body, a refrigerator housed in the case body and providing a refrigeration cycle comprising a compressor, condenser, pressure reducing means and evaporator, and a cold air circulating blower housed in the case body for supplying air cooled by the evaporator in circulation, the air duct having a forward air channel for transporting the cold air cooled by the evaporator therethrough to the cold air supply portion, and a return air channel independent of the forward air channel for transporting cold air from the cold air discharge portion to the evaporator therethrough.

Thus, the device of the present invention has the basic construction that the machine case is disposed a distance away from the display case and held in communication therewith by the air duct. First, the display case in made compact and lightweight and openably closed with a cover member which can be seen through, so that commodities can be displayed with an improved effect while being cooled efficiently and yet can be withdrawn from the display case easily. Accordingly, the display case of the present device, for example, for use in pharmacies, discount stores or like stores can be installed on other display cases on which relatively heavy articles should not be placed.

Further because the machine case is separate from the display case and held in communication therewith only by the air duct, the machine case can be installed in the dead space which is usually formed under a display box which is used in pharmacies, discount stores or like stores. On the other hand, only the air duct which is slender and freely positionable extends across one side of the display box, so that the provision of the air duct entails no need to alter the construction of the display case and exerts little or no influence on the exhibition of commodities or sales activity.

From another viewpoint, the present invention provides a display case cover member which can be opened and seen through and is so adapted not to leak the cold from the interior of the display case. The cover member comprises a plurality of transparent plates, and an annular frame extending along the peripheral edges of the plates and supporting the plates thereon as spaced apart and positioned one over another.

From another viewpoint, the present invention further provides as means for placing the display case cover member thereon a horizontal portion which is formed on the air passage defining member having the cold air supply portion and cold air discharge portion and on which the cover member openably rests. This structure permits commodities to be easily withdrawn from inside the display case.

BRIEF DESCRIPTION OF THE DRAWINGS

FIG. 2 is a diagram illustrating the relationship between the position of center of a display table, i.e. turntable, thereof and a cold air outlet of a cold air supply portion;

DESCRIPTION OF THE PREFERRED EMBODIMENTS

Figure 1:
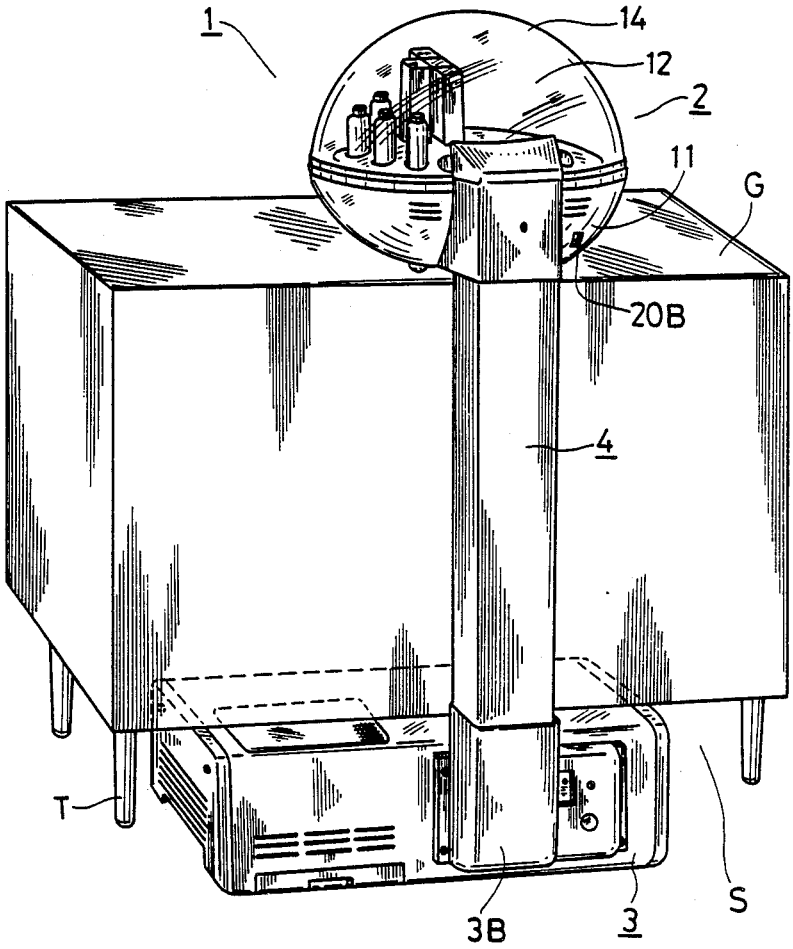
FIG. 1 is a perspective view showing a refrigeration showcase device embodying the invention in use.

With reference to FIG. 1 first, indicated at G is a display case for use in pharmacies, discount stores or like stores. The case G has a chamber for displaying commodities and legs T extending downward therefrom and forming an unused space S.

A refrigeration showcase 1 comprises a closed-type display case 2, a machine case 3 separate from the display case 2, housing mechanical components therein and disposed at a position away from the display case 2, for example in the space S for sending out cold air, and an air duct 4 holding the two cases 2, 3 in communication with each other for the passage of air therethrough and covered with a heat insulating material for inhibiting the rise of temperature of the cold air. In accordance with the type of commodities accommodated in the display case, the rang of temperatures to be controlled is variable for selective use for refrigeration, for giving ice temperature or for heating the display case. The present embodiment will be described as adapted for use as a refrigeration showcase.

With reference also to FIGS. 2 to 5, the display case 2 comprises a base 11 having on its upper side a turntable 13 serving as a display table and rotatably removably supported for placing commodities thereon, and a treatment cover member thereinafter referred to as a "hood") 14 covering the commodities on the turntable 13 and defining a commodity chamber 12 above the base 11. The display case 2 is placed on a support, for example, on the display case G.

Below the turntable 13 serving as the bottom wall of the commodity chamber 12, the base 11 forms an air passage chamber (member) 15 and an illumination chamber 16 under the chamber 15. The base 11 is generally circular when seen from above. The two chambers 15, 16 are separated by a partition plate 17, a heat insulating member 18 and a heat insulating transparent member, e.g., a three-layer transparent glass member 19.

Figure 3A:
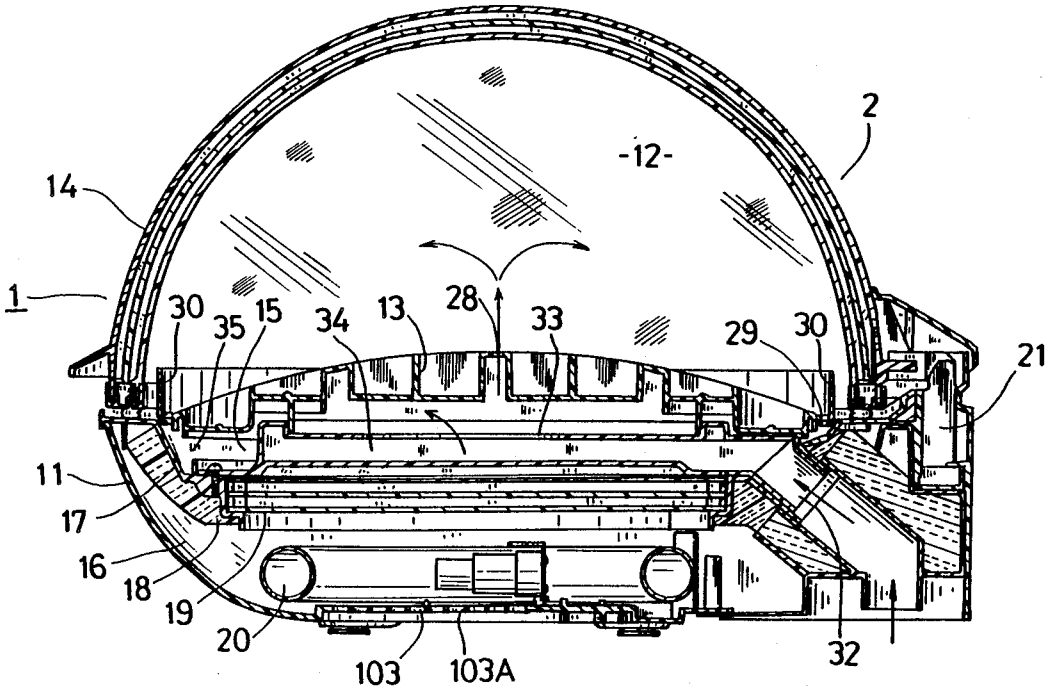
FIG. 3(A) is a sectional view of a showcase.
Figure 3B:
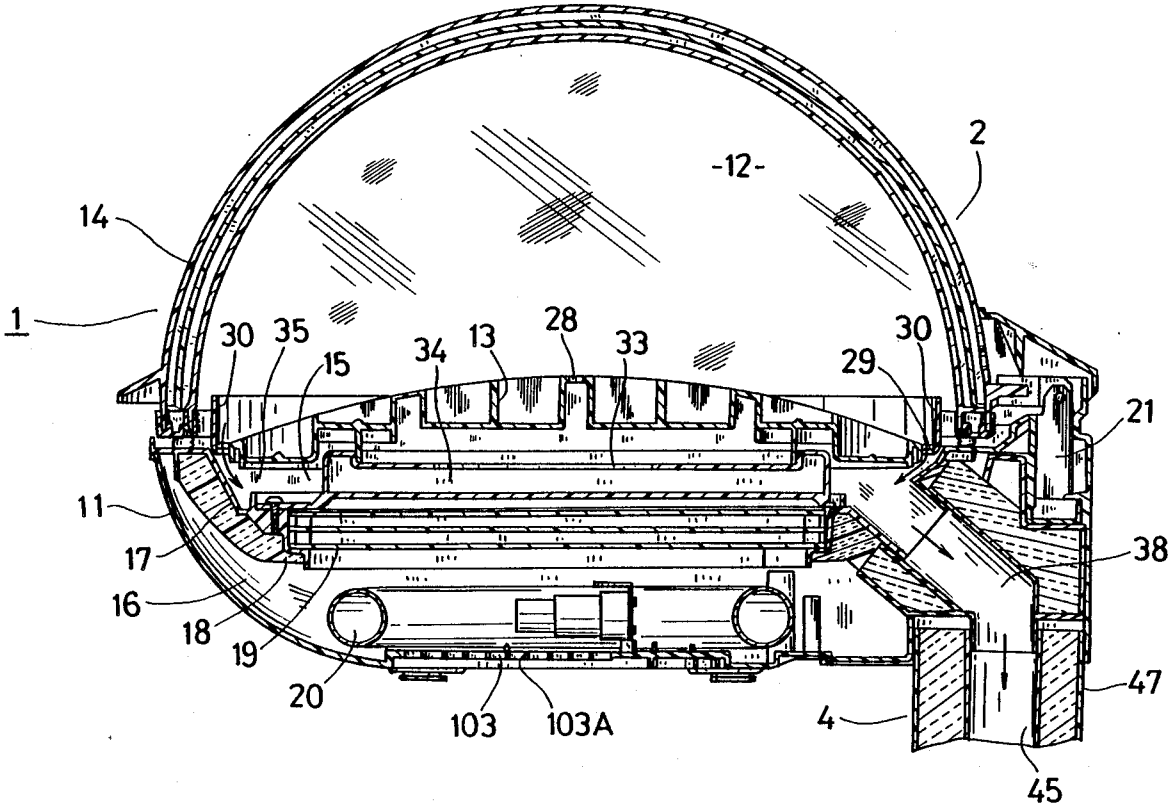
FIG. 3(B) is a view in different section and corresponding to FIG. 3(A)
Figure 5:
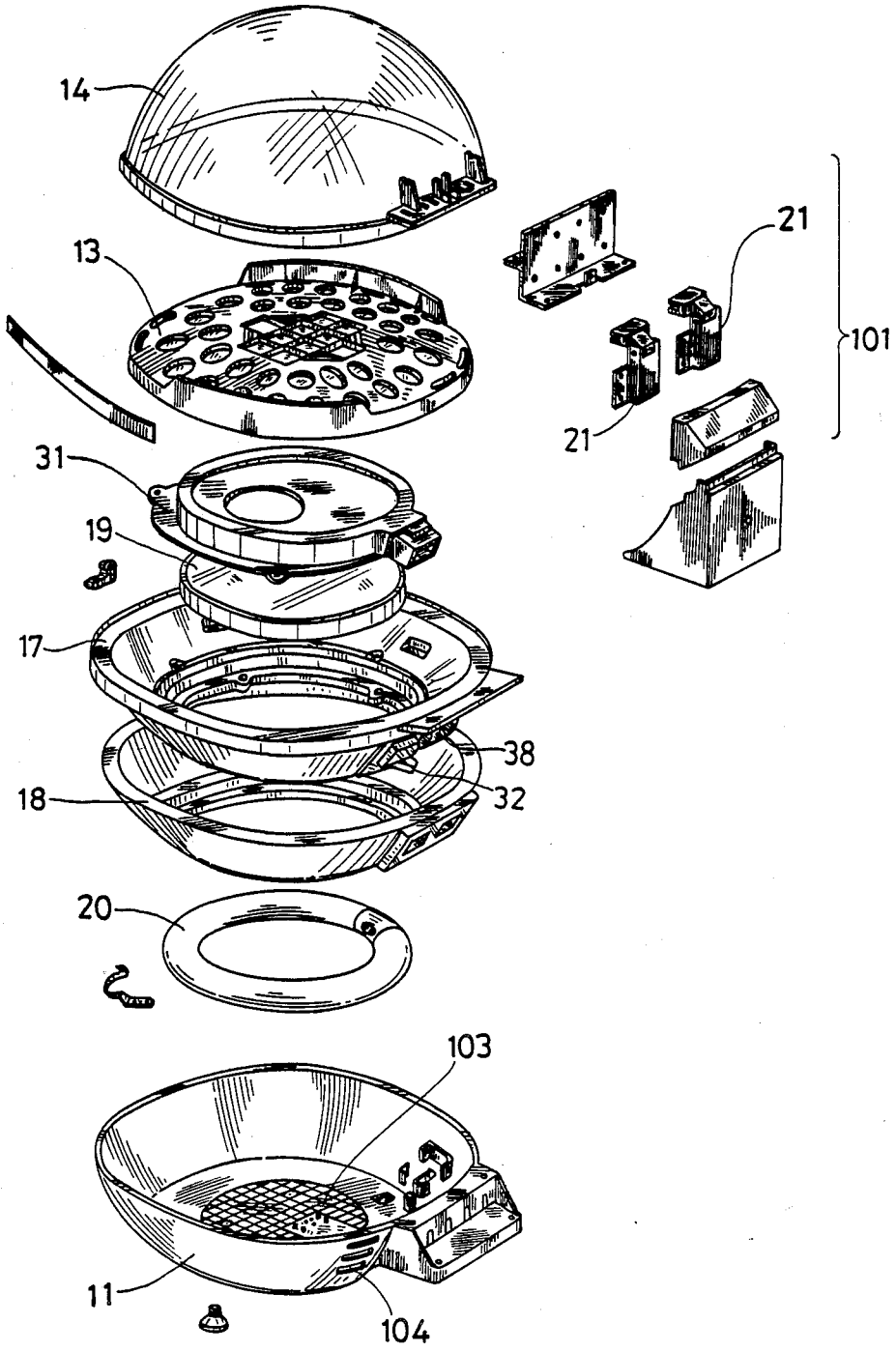
FIG. 5 is an exploded perspective view of the display case.
Figure 6:
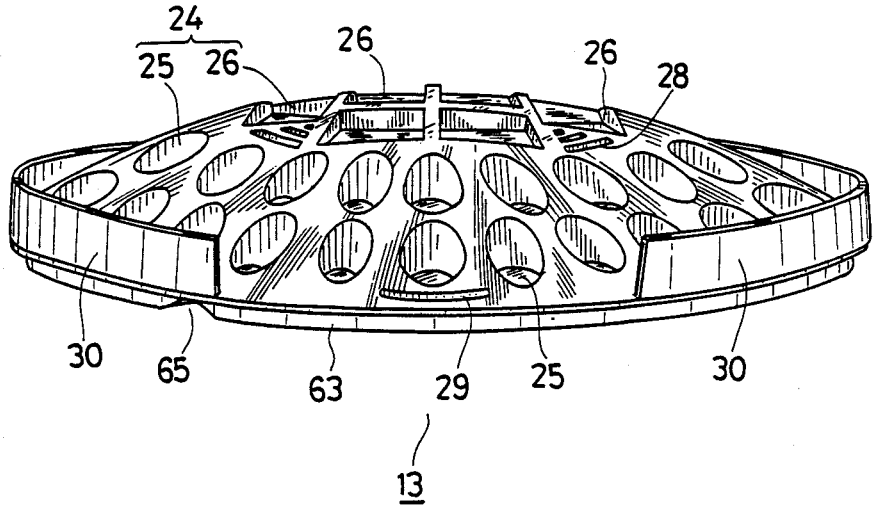
FIG. 6 is a perspective view of the turntable.
Figure 7:
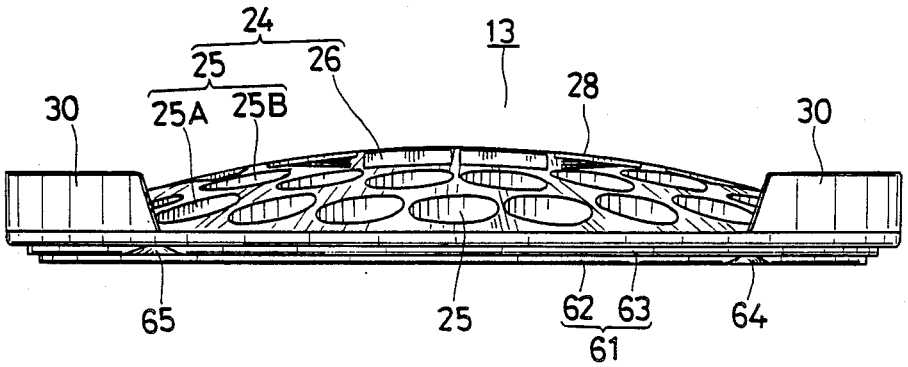
FIG. 7 is a front view of the turntable as it is seen from a different direction.
Figure 8:
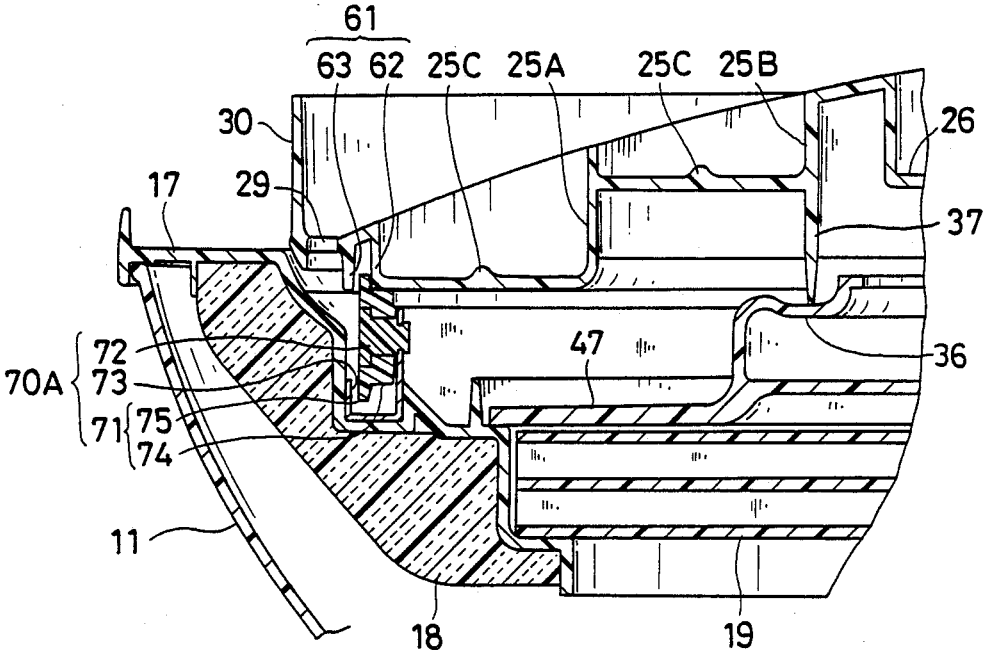
FIG. 8 is a fragmentary view in section of the display case.
Figure 9:
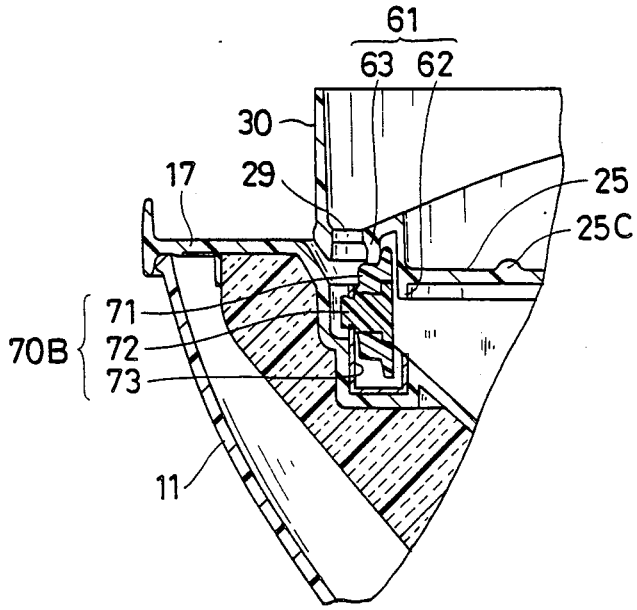
FIG. 9 is a fragmentary view showing the display case in a different section.
Figure 10:
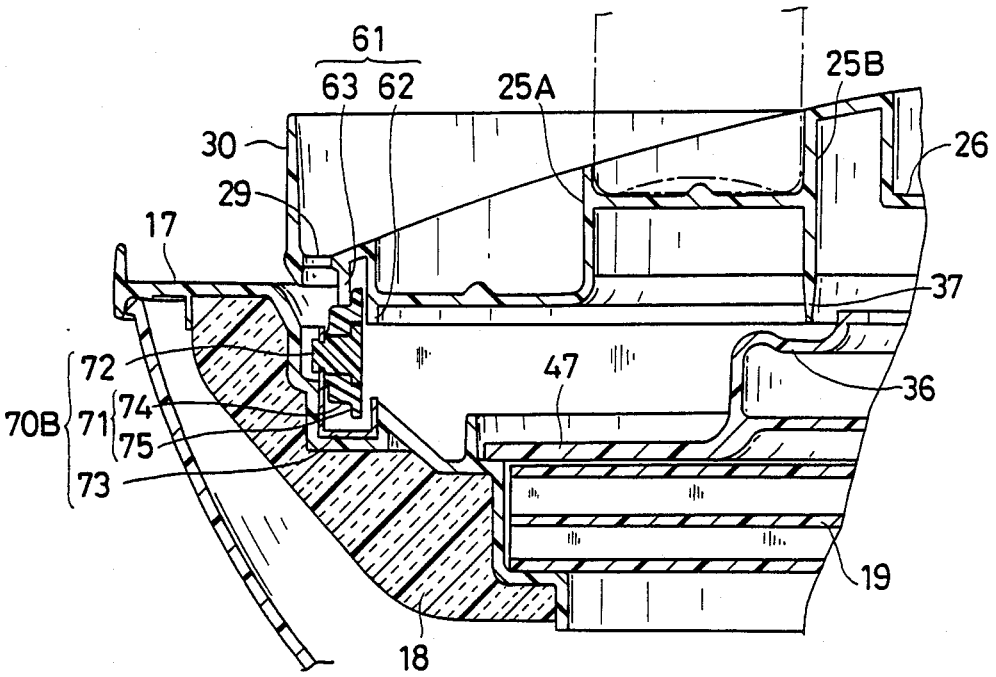
FIG. 10 is a fragmentary view showing the display case in another different section.
Figure 11:
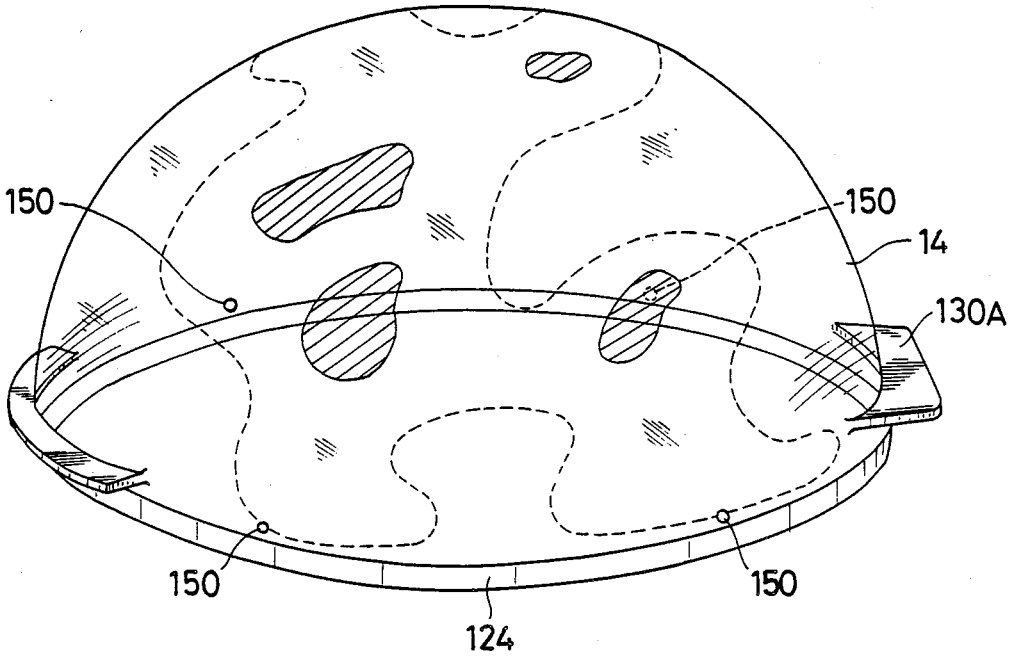
FIG. 11 is a perspective view of a hood to illustrate water vapor release ports.
Figure 12:
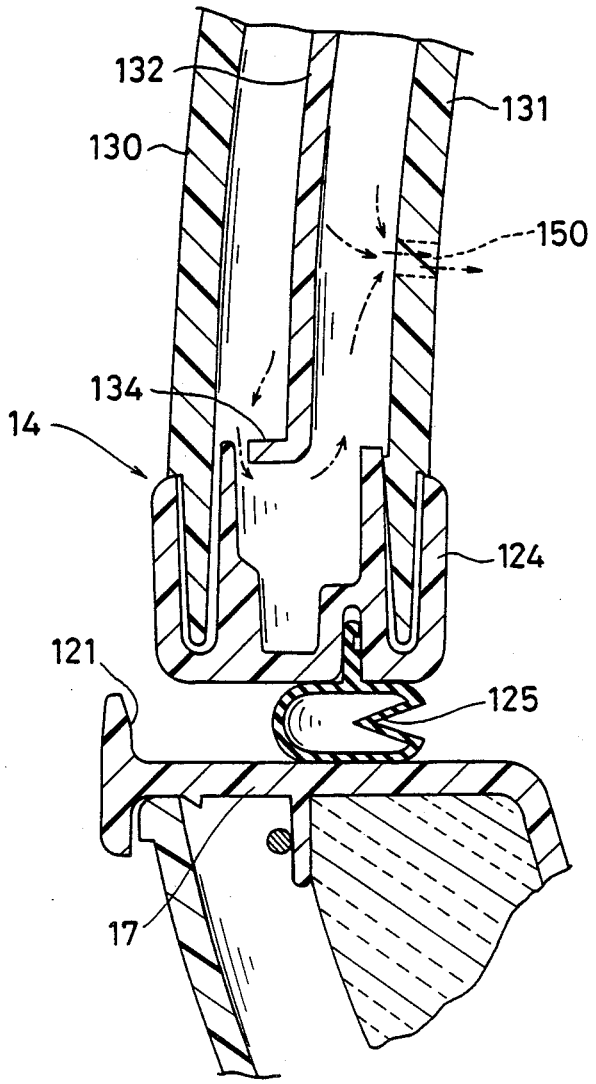
FIG. 12 is a fragmentary view in section for illustrating the relationship between the hood and a partition plate.
Figure 13:
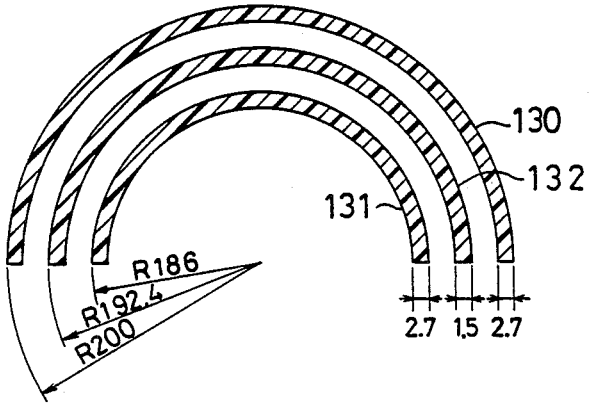
FIGS. 13 and 14 are diagrams for illustrating the construction of the hood.
Figure 14:
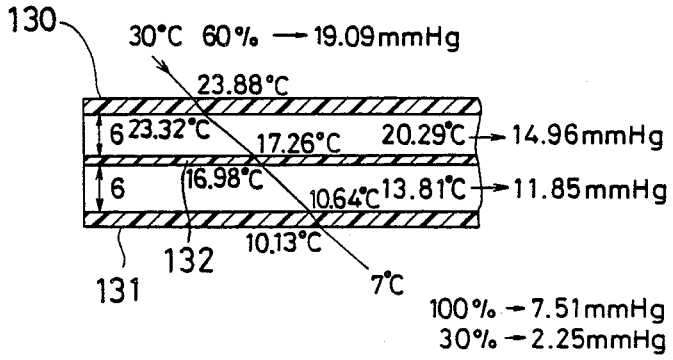
Figure 15:
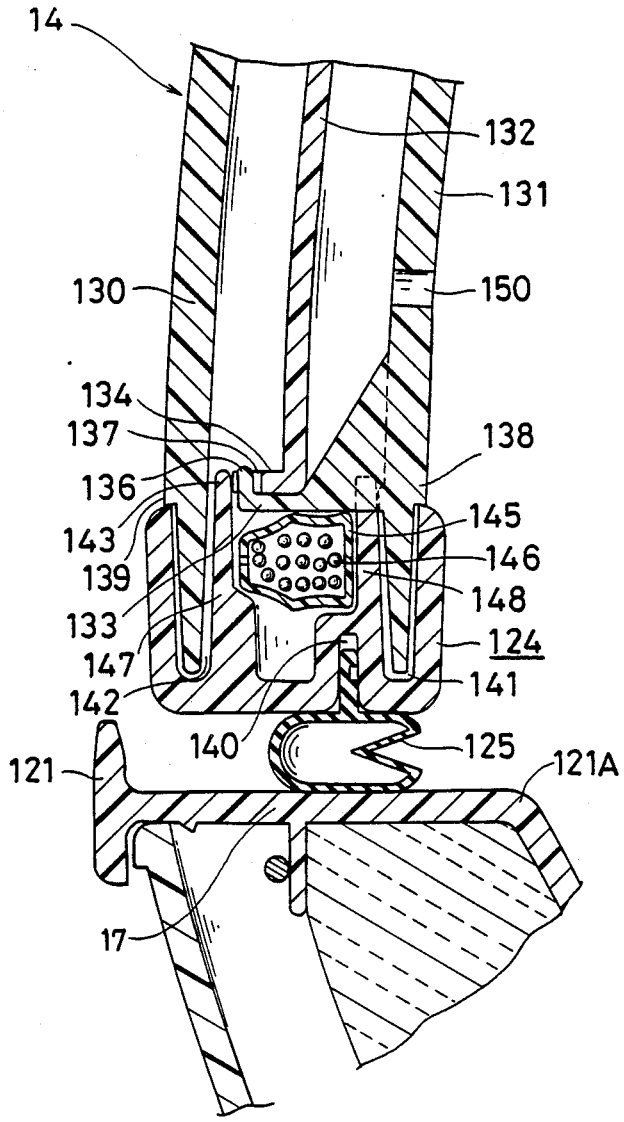
FIG. 15 is a view corresponding to FIG. 12 and showing the same relationship in a different section.
Figure 18:
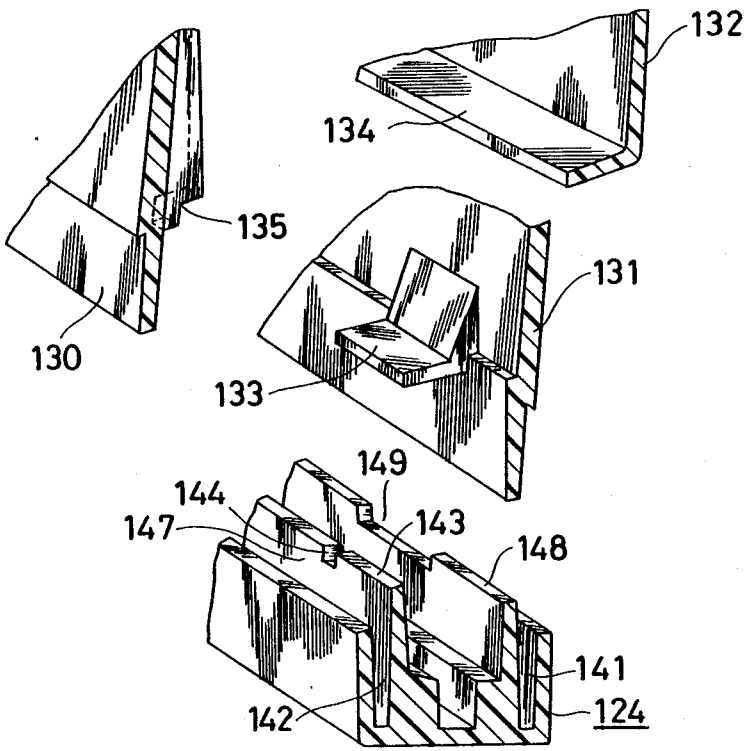
FIG. 18 is a view corresponding to FIG. 16 and showing different portions.
Figure 16:
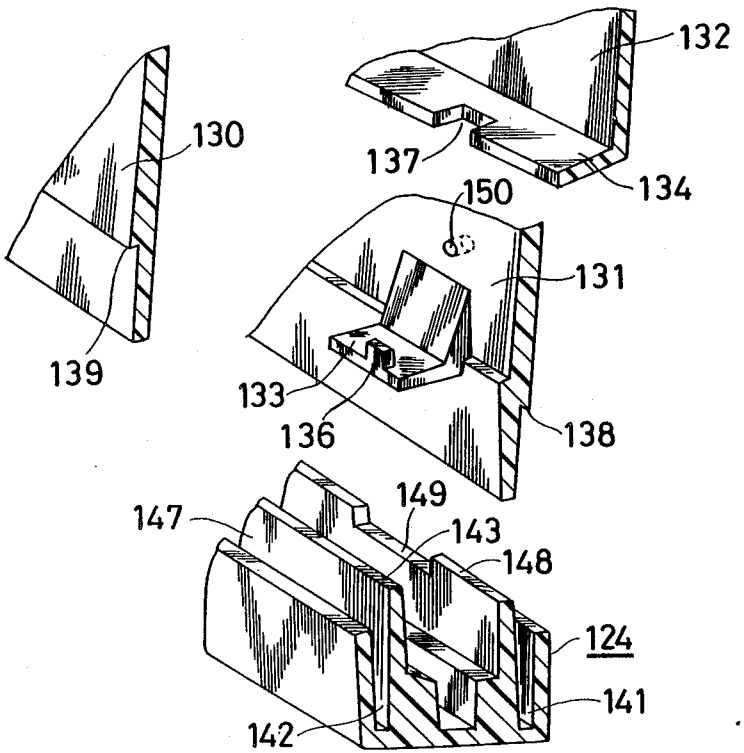
FIG. 16 is an exploded perspective view showing a plurality of transparent plates providing the hood as related to an annular frame.
Figure 17:
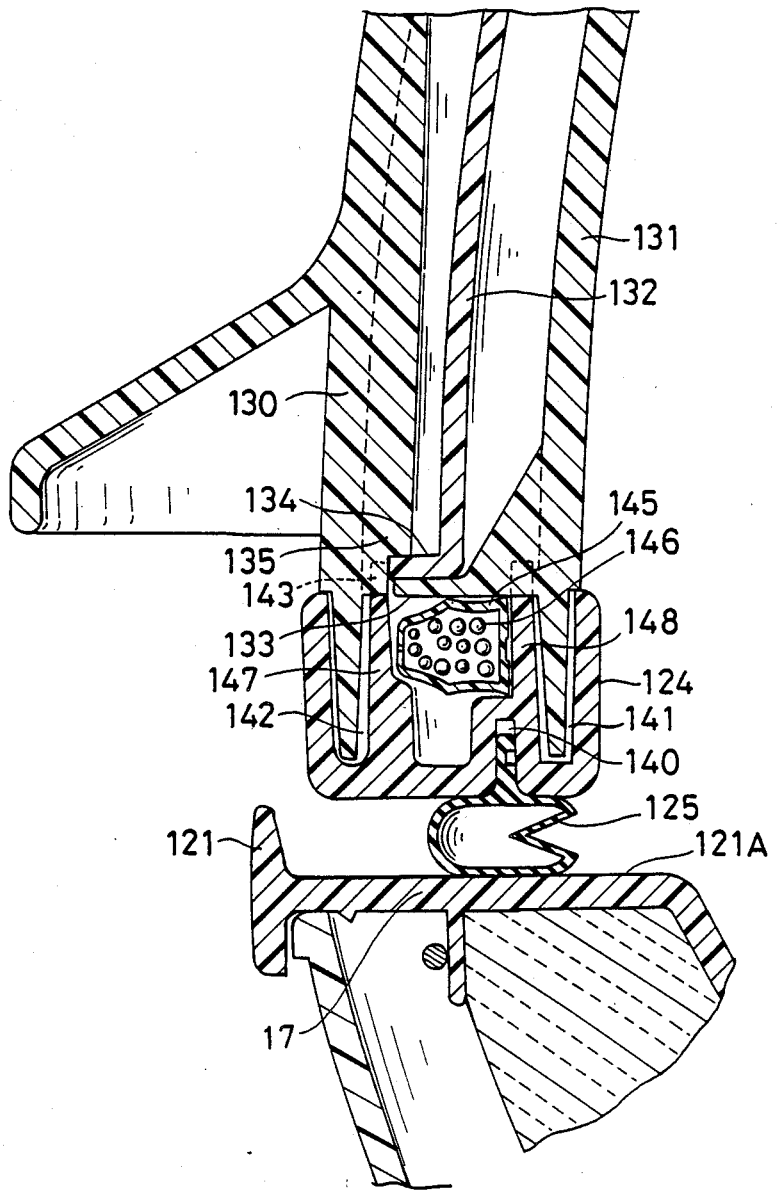
FIG. 17 is a view corresponding to FIG. 15 and showing the same relationship in another different section.
Figure 19:
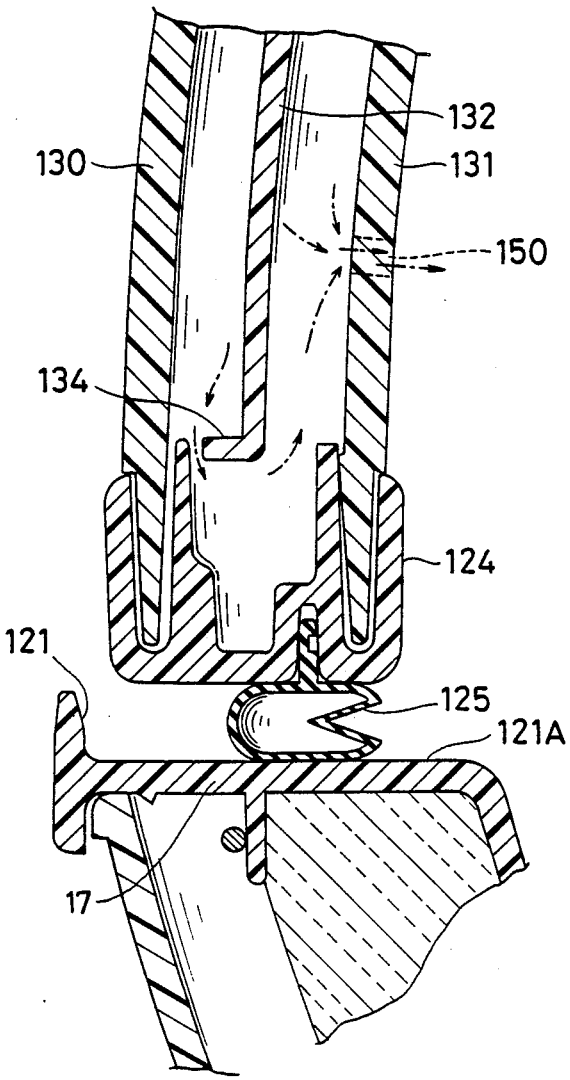
FIG. 19 is a fragmentary view in section for illustrating air flowing through the hood.

With reference to FIGS. 3 and 5, the illumination chamber 16 has illumination means including a circular fluorescent lamp 20, as a light source, immediately below the glass member 19. The frame of the base 11 is formed in its bottom with an air passage portion 103, as an outside air intake opening, having a smaller diameter than the lamp 20 and has an air discharge portion 104, as an air release opening, in the vicinity of a hinge 21 at its rear portion. The air passage portion 103 is provided with a lattice 103A, and an unillustrated net filter for preventing ingress of dust and insects and permits passage of air therethrough, further allowing the light emitted by the fluorescent lamp 20 to pass downward therethrough. With reference to FIG. 15, the upper end of the base frame is restrained from moving outward by a restraining flange 121 extending upright from the outer end of a horizontal portion 121A of the partition plate 17. The frame upper end is also restrained from moving inward by a ridge provided on the underside of the horizontal portion 121A. When water droplets deposited on a packing 125 beneath the lower edge of the hood 14 accumulate on the horizontal portion 121A, the restraining flange 121 prevents the water from dripping outward from the horizontal portion 121A. The flange also serves to hold the packing 125 out of sight. The outer surface of the base frame is coated with a metallic or like coating composition to block light in the present embodiment. The transparent glass member 19 comprises a plurality of (i.e. three in the present embodiment) glass sheets arranged in parallel at a spacing to effect heat insulation by the air layers and to pass light therethrough.

With reference to FIGS. 1 to 3, the fluorescent lamp 20 is disposed under the three-layer glass member 19. Utilizing the central space of the lamp 20, electric parts such as a glow lamp are provided in the space. A power supply switch 20B for the lamp 20 is mounted on a suitable portion of the base 11, for example, beside a cover for the hinge 21. At least while the fluorescent lamp is off, a heater is preferably held on automatically.

Figure 4:
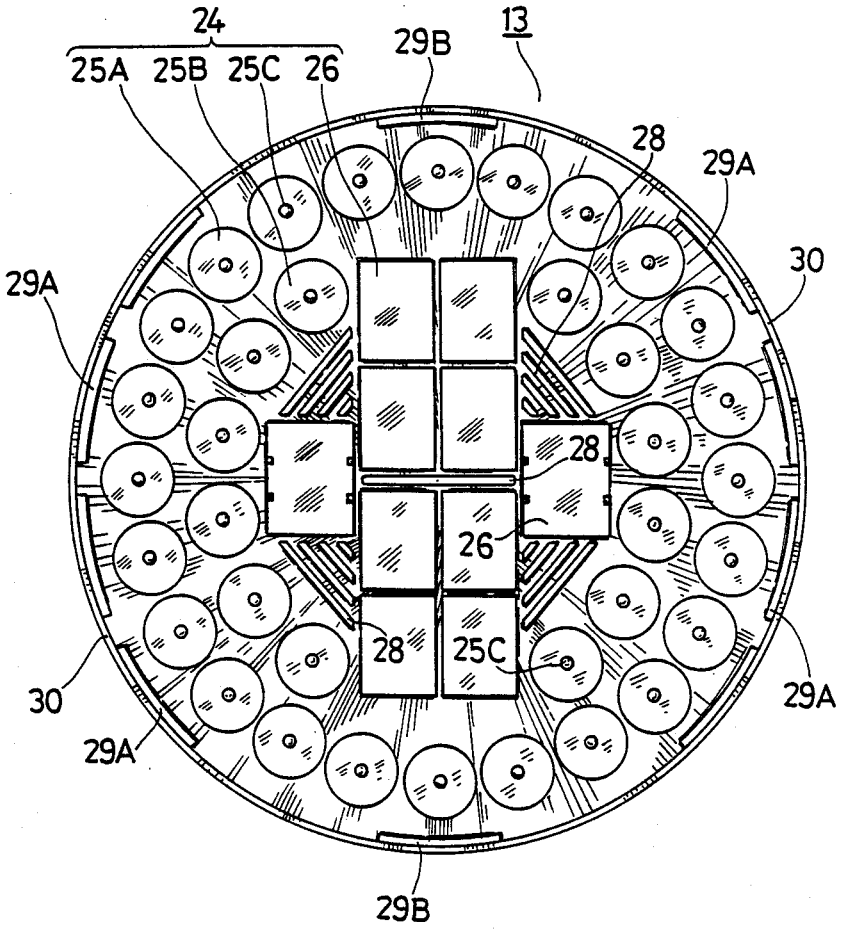
FIG. 4 is a plan view showing the turntable.

With reference to FIG. 4, the turntable 13 is circular when seen from above and spherical (i.e. a portion of the curved surface of a sphere) when seen sidewise, such that it is highest at its center and gradually lowers toward its outer periphery. The turntable is free to rotate relative to the base 11.

For the turntable to support a multiplicity of beverage containers thereon as spaced apart from one another properly, the turntable is formed with cavities 24, more specifically 25A, 25B and 26, orderly arranged and shaped approximately in conformity with the plan-view shapes (e.g., circular or rectangular) of the container bottom portions for individually receiving the bottom portions. The cavities have their bottoms positioned at a higher level inwardly of the turntable 13. For example according to the present embodiment, the turntable 13 is formed in an annular arrangement with 24 circular cavities 25A at its outermost portion along the periphery and 12 circular cavities 25B positioned inwardly of and at a higher level than the outer cavities 25A. Further formed inwardly of the inner cavities 25B are 10 rectangular cavities 26. Each circular cavity 25 has a tapred projection 25C about 1.5 to 2.5 mm in height. The turntable is formed at portions thereof other than the cavities 25A, 25B and 26, with air outlets 28, as cold air outlet openings which are made suitably different in shape and number at the different portions. Intake openings 29A, 29B are symmetrically formed in the turntable outwardly of the cavities toward the outermost portion of the turntable.

The turntable 13 has handle portions 30 positioned outwardly of the intake opening 29A and each in the form of an upright wall curved circumferentially of the turntable for use in rotating the turntable 13. The handle portions are usable for POP advertisement for showing the names, prices, etc. of the commodities on display and also serve to inwardly and downardly directing the cold. air supplied to the commodity chamber 12 and prevent the cold air to strike on the lower portion of the hood 14. The handle portion 30 may be formed along the entire outer periphery of the turntable 13, but with the present embodiment, two handle portions 30 are provided at the front side (opposite to the hinge means 21) of the display case 2 and the rear side thereof (at the hinge side) symmetrically. Each handle portion 30 is a circular-arc wall subtending an angle of 90 degrees at the center of the turntable. The intake opening 29A positioned inside the handle portions 30 are larger in number than the intake opening 29B at the other portions to provide a larger opening area, with the result that the cold air forced out into the commodity chamber 12 is predominantly drawn into the intake opening 29A, reducing the amount of cold air striking on the lower portion of the hood 14 even at the locations where no handle portion 30 is provided.

With reference to FIGS. 6 to 10, the turntable 13 has on its underside an annular recessed portion 61 along its outer periphery for rotation assisting members 70, i.e., first and second rotation assisting members 70A, 70B, to support the turntable 13.

The annular recessed portion 61 has an annular inner wall 62 supported by the first rotation assisting member 70A, and an annular outer wall 63 supported by the second rotation assisting member 70B. The inner wall 62 is formed with two first cutouts 64 which are spaced apart by 180 degrees about the center of the turntable for the first member 70A to fit in. The outer wall 63 is formed with two second cutouts 65 which are spaced from the respective first cutouts 64 by 90 degrees about the center for the second member 70B to fit in. Preferably each of the cutout portions 64, 65 is defined by edges gently slanting away from its center. When the rotation assisting members 70A, 70B are positioned at the cutouts 64, 65, respectively (with the turntable 13 in a specified position), the handle portions 30 are at the front and rear sides of the showcase 1.

The turntable 13 is provided on its underside with an annular vertical wall 37 opposed to a step 36 of the cold air supply portion 34 to be described later, such that when the turn table 13 is in the specified position, a closed space is formed between the lower surface of the turntable 13 and the partition member 31 to be described later. When the turntable 13 is positioned with the vertical wall 37 fitted in the step 36, the recessed portion 61 is properly supported by the assisting members 70. Thus, the vertical wall 37 and the step 36 also serve the function of positioning the turntable 13 in place. The annular vertical wall 37 also serves as a reinforcement for giving enhanced strength to the underside of the turntable 13.

The rotation assisting members 70 act to support the turntable 13 horizontally under a uniform load, and are positioned immediately under the central portions of the respective cutouts when the turntable 13 is in the specified position. Each assisting member 70 comprises a rotor 71, a pin 72 for rotatably supporting the rotor 71 and a holder 73 for fixedly supporting the pin 72 and attaching the member 70 to a suitable portion. The rotor 71 is in the form of an integral assembly of concentric two disks which are different in diameter. The disk portion of small diameter serves as a contact piece 74, and the disk portion of large diameter as a restraining piece 75. The rotor 71 has a central hole for the pin 72 to extend therethrough. The contact piece 74 of the first rotation assisting member 70A supports the inner wall 62 from below, with the restraining piece 75 positioned between the inner wall 62 and the outer wall 63. Thus, the contact piece 74 is positioned inwardly of the other piece 75. On the other hand, the second rotation assisting member 70B is so oriented that the contact piece 62 thereof is positioned outwardly of the restraining piece 63 to support the outer wall 63 from below, with the restraining piece 75 located between the inner and outer walls 62, 63. Accordingly, the cutout portions 64, 65 formed in the inner and outer walls 62, 63 can be supported and stopped stably by the contact pieces 74 of the rotors 71 every time the turntable 13 is rotated through 180 degrees, with the handle portions 30 properly positioned at the front and rear sides of the display case 2.

The air passage chamber 15 will be described for illustrative purposes. With reference to FIGS. 1 to 3, the chamber 15 is formed by the underside of the turntable at the bottom of the commodity chamber 12, the partition plate 17 and the partition member 31 separating a high-pressure space from a low pressure space. The partition member 31 has a cold air supply portion 34 in the form of a hollow cylinder and has at its one side a cold air inlet 32 for receiving cold air from the machine case 3 through the air duct 4 and in its top an opening 33 serving as a cold return air outlet (see FIG. 2). A cold air return portion 35, as a cold air discharge portion, is provided around the side wall of the cold air supply portion 34. In the above arrangement, the cold air introduced into the portion 34 through the inlet 32 is guided toward the opening 33. If the opening is formed immediately below the turntable 13 concentrically therewith, the air will be admitted into the commodity chamber 12 in a larger amount through the air outlets 28 in the central portion of the turntable 13 than through the outlets 28 in the other portion thereof and is more likely to strike against the top portion of the hood 14 to fog up this portion. Further since the cold air forced out is drawn toward a return cold air outlet 38 which is provided at one side of the inlet 32, the air will not smoothly flow from the center of the turntable toward the other side, with the result that the interior of the commodity chamber 12 is cold at one portion and yet remains uncooled at another portion, hence the objection of an uneven internal temperature distribution. To avoid this problem, the cold air inlet 32 is provided at one side of the position immediately below the center of the turntable 13, with the opening 33 positioned toward the other side thereof eccentrically of the turntable. Thus according to the invention, the opening 33, which is circular, is formed in the top wall of the cold air supply portion 34, with its center positioned toward the other side away from the position immediately below the center of the turntable 13. The opening 33 need not always be circular but can be square, rectangular or elliptical.

The cold air transported through the air duct 4 as directed upward is deflected horizontally in the supply portion 34 and deflected upward again at the opening 33. Since the inlet 32 is disposed at one side of the position immediately below the center of the turntable 13, with the opening 33 positioned closer toward the other side thereof, the air can be forced out in a larger amount through the outlets 28 in the turntable 13 which are close to its outer periphery (especially through those at the other side away from the inlet 32) than through the outelts 28 in the central portion. Moreover, the air can be forced out obliquely upward instead of being directed directly upward, with the result that a reduced amount of air strikes against the top portion of the hood 14, whereby the interior of the chamber 12 can be cooled uniformly.

The cold air supply portion 34 has the step 36 which is annular and on which the annular vertical wall 37 on the underside of the turntable 13 rests to position the turntable 13 in place. When the turntable 13 is thus positioned, a closed space is defined by the lower surface of the turntable and the partition member 31, whereby the cold air 33 flowing out is prevented from returning directly to the return portion 35 without entering the commodity chamber 12.

The dew produced on the hood 14 or in the commodity chamber 12 flows along the horizontal portion 121A of the partition plate 17 inward or spontaneously falls under gravity through the intake openings 29 in the turntable 13 or beyond the periphery of the turntable 13, and enters the cold air return portion 35 of the air passage chamber 15. The dew, i.e., water condensate or water, is guided to the cold air outlet 38 along ribs (not shown) suitably formed on the partition plate 17 along the direction of flow of the return cold air, admitted into a return tube 45 in the air duct 4 via the junction between the display case 2 and the duct 4 and forwarded along with the return air to the bottom of a heat exchanger portion 91 in the machine case 3. Along with the water resulting from defrosting of an evaporator 86, the water condensate is discharged to an evaporating tray 84 via a drain port 96 and water discharge tank. Thus, the dew is guided from the display case 2 to the machine case 3 utilizing the return tube 45 of the air duct 4 without the necessity of using any special means for conducting the dew. The return cold air also acts to promote the transfer of the dew or water condensate.

With reference to FIGS. 11 to 19, the hood 14 defining the commodity chamber 12 consists mainly of a plurality of transparent plates made of a transparent resin such as acrylic resin, shaped three-dimensionally, for example, to a semispherical form with a bottom opening and spaced apart from one another in layers. According to the present embodiment, the hood 14 chiefly comprises three plates, i.e., an outer plate 130, an inner plate 131 and a middle plate 132. The outer plate 130 providing the outermost layer has a fixing piece 130A projecting outward from a lower portion thereof and fastened to the hinge means 21. The spacing between the plates 130 to 132 is so determined that convection of air will not readily occur in the intervening air layers so as to utilize the air layers as heat insulating layers. With the present embodiment, the spacing is about 5 mm. An annular frame 124 of resin extends along the lower ends of the inner and outer plates 131, 130 over the entire circumference thereof, i.e., along the bottom opening. The aforementioned packing 125 for sealing the space between the hood 14 and the base 11 (more particularly the horizontal portion 12A of the partition plate 17) is fixed in a groove 140 formed in the underside of the frame 124 over the entire circumference thereof. According to the present embodiment, the space defined by the inner plate 131 and the middle plate 132 is in communication with the space defined by the outer plate 130 and the middle plate 132 at their lower ends. The middle plate 132 has a smaller thickness than the other plates 130, 131. The inner plate 131 and the outer plate 130 are formed by injection molding, and the middle plate 132 by blow molding, with the result that the middle plate 132 is not uniform in thickness and decreases in thickness toward its top.

The inner plate 131 has support portions 133 extending toward the outer plate 130 for placing thereon an outward flange 134 at the lower end of the middle plate 132. The outer plate 130 has restricting portions 135 for preventing the flange 134 of the middle plate 132 from moving upward (see FIGS. 17 and 18). The annular frame 124 or the support portion 133 is formed with a restraining portion 143 for restraining the middle plate flange 134 from moving outward. The inner plate 131 and the outer plate 130 are inserted at their lower ends in an inner groove 141 and an outer groove 142, respectively, of the frame 124 and are thereby joined to the frame 124. In this case, an adhesive is placed into the grooves 141, 142 to hold the inner and outer plates 131, 130 to the frame 124 airtightly. The support portions 133 and the restricting portions 135 are provided on suitable portions of the hood 14, e.g., on the front side (opposite to the hinged side) of the hood 14, on the rear side (hinged side) thereof, and lateral sides thereof. The restraining portion 143 provided on the frame 124 is formed with a cutout 144 (see FIG. 18) for the restricting portion 135 to fit in, whereby the outer plate 130 is positioned in place.

An annular sash 145 containing a drier 146 is provided between a pair of intermediate walls 147, 148 on the frame 124. Those of the support portions 133 which are not in corresponding relation to the restricting portions 135 (e.g. the portions 133 on the lateral sides of the hood) are each formed with a projection 136 extending upward and engaged in a cutout 137 to hold the middle plate 132 against rotation. The intermediate wall 148 of the frame 124 is formed in its upper edge with a cutout 149 for the support portion 133 to engage in, whereby the inner plate 131 is positioned in place against rotation.

Water vapor ports 150 (small vents) of a suitable size for permitting water vapor to pass therethrough between the commodity chamber 12 and the air layers in the hood 14 are formed in suitable portions of the inner plate 131, for example, immediately above the support portions 133 having the middle plate flange 134 placed thereon and provided with the projection 136. The partial pressure of water vapor in the air within the commodity chamber 12 which is given a reduced humidity by being cooled with the circulating cold air is held in an equilibrium with the partial pressure of water vapor in the air layers within the hood 14 through these ports 150, whereby the amount of water vapor in the air layers within the hood 14 is reduced. Thus, the ports 150 act as aspirator holes. The reduced water vapor content of the air layers in the hood 14 obviates the likelihood that water vapor will be condensed on the outer surface of the inner plate 131 to fog up the plate or form water droplets thereon even if the inner plate 131 is cooled with the cold air inside the commodity chamber 12, with the result that the hood 14 can be seen through satisfactorily.

The hood 14 of the foregoing construction is assembled by the following procedure. First, an adhesive is applied to the inner groove 141 and outer groove 142 of the annular frame 124, the sash 145 is fitted in the frame 124, and the opening edge of the inner plate 131 is then inserted into the inner groove 141. At this time, a stepped portion 138 in the inner surface of the inner plate 131 comes into contact with the upper edge of the inner wall of the frame 124 to limit the depth of insertion, preventing overflow of the adhesive, while the support portions 133 prevent the sash 145 from slipping off upward.

The middle plate 132 is then placed over the inner plate 131 to position the flange 134 on the support portions 133. At this time, the projection 136 on the support portion 133 engages in the cutout 137, whereby the middle plate 132 is positioned in place against rotation.

The outer plate 130 is subsequently placed over the middle plate 132. At this time, the restricting portion 135 engages in the cutout 144 to position the outer plate 130 in place and is opposed to the upper surface of the flange 134, while the opening edge of the outer plate 130 enters the outer groove 142 (see FIGS. 17 and 18). Furthermore, a stepped portion 139 formed in the outer surface of the outer plate 130 comes into contact with the outer wall upper edge of the frame 124 to limit the entry of the plate 130 into the outer groove 142. When required, the flange 134 may be spot-adhered to the support portion 133.

The packing 140 is fixed, at its base portion made of rigid material, into the groove 140 in the underside of the frame 124 with adhesive. The packing is thus attached to the frame 124 usually before the inner plate 131 is attached to the frame, but this step may be performed after the attachment of the outer plate 130 to the frame 124.

With the present embodiment, the inner plate 131 has the water vapor ports 150 serving as aspirator holes, but alternatively, a hole for filling a heat insulating gas and an air vent for this purpose (both holes are not shown) may be formed in the outer plate 130 as well as in the middle plate 132 at suitable portions, e.g., at the hinged side, thereof. In this case, sulfur hexafluoride, argon or like heat insulating gas is filled into the space between the middle and inner plates 132, 131 of the assembled hood 14 and also into the space between the middle and outer plates 132, 130 thereof to preclude fogging or condensation of water vapor in the inside spaces of the hood 14.

The inner, middle and outer plates thus arranged in three layers are fixed together with the inner and outer plates 131, 130 held in position by the annular frame 124 against rotation. The outward flange 134 of the middle plate 132 is held between the support portions 133 of the inner plate 131 and the restricting portions 135 of the outer plate 130 thus fixed (see FIGS. 17 and 18), whereby the flange is prevented from upward or downward movement and also from rotation. Consequently, the three plates can be fixedly positioned while being restrained from rotation. In assembling the hood 14, the plates are attached to the annular frame 124 in the order of the inner plate 131, the middle plate 132 and the outer plate 130, with their bottom openings down, so that the components can be assembled in a highly stabilized state. Further with the projection 136 on the support portion 133 of the inner plate 131 engaged in the cutout 137 as a small hole in the outward flange 134 of the middle plate 132, the middle plate 132 can be held at a suitable spacing from the inner plate 131, while the flange 134 and the restraining portion 143 holds the middle plate 132 spaced from the outer plate 130. This arrangement therefore eliminates the need to use spacers between the plates.

The water vapor ports 150 will be described with respect to the diameter and number thereof. (The present embodiment is adapted for refrigeration, the air inside the commodity chamber is dehumidified by refrigeration, and the ports perform the function of an aspirator, so that the ports will hereinafter be referred to as "aspirator holes.") The acrylic resin forming the hood 14 has high water vapor permeability of 31.6 (g-mm/m$^3$.24 hr.atm), i.e. high moisture permeability. Consequently, moisture migrates from the outside air having a high water vapor pressure toward the air inside the commodity chamber having a low water vapor pressure during refrigeration. Suppose the ambient temperature is 30° C., the internal temperature of the commodity chamber is 7° C., and the ambient and internal humidities are both 100%. It is also assumed that the water penetrating through the outer plate 130 is totally absorbed by the drier (dehumidifying agent) 146, such as molecular sieve or silica gel, provide inside the hood. The amount of water M [=(water vapor permeability×surface area×partial pressure difference)/plate thickness] penetrating into the hood is then given by:

$$M=31.6\times0.2446\times31.82/2.7\times760=0.12\ (g/24\ hr) \quad (1)$$

wherein 31.82 (mm Hg) is saturated water vapor pressure at 30° C., and 0.2446 (m$^2$) is the outer surface area of the outer plate 130. The pressure difference between the interior of the hood and the commodity chamber is smaller than that between the ambient atmosphere and the interior of the hood (see FIG. 19) so that the water penetrating into the hood remains therein to eventually undergo condensation. Accordingly, the water penetrating into the hood must be reliably transferred into the commodity chamber (by providing such aspirator holes that the amount of water, m, flowing into the chamber through the inner plate is greater than M). Suppose the outer plate 130, the inner plate 131 and the middle plate 132 are planar and arranged in three layers, and the ambient temperature and the internal temperature are the same as given above. The plates then have the surface temperatures shown in FIG. 14. The outer surface of the inner plate has a temperature of 10.64° C., and the saturated water vapor pressure at this temperature is 9.61 mm Hg. The pressure difference Δh between the inside air of the hood and the air in the commodity chamber, as expressed in pressure head, is given by:

$$\Delta h=(9.61-7.51)\times 10.33/760=2.85\times 10^{-2}\ (\text{m Aq})$$

The transfer of water from inside the hood to inside the chamber is equivalent to the reduction of the pressure difference to zero, i.e., to the change of Δh from $2.85\times 10^{-2}$ m to 0 m. From the equation $v=\sqrt{2gh}$, the average outflow velocity of water, $\bar{v}$, is given by:

$$v=\int_0^{2.85\times 10^{-2}}\sqrt{2gh}\ dh=0.0142\ (m/S)$$

Assuming that the area of the aspirator hole is A, the amount of air flowing out, G, is given by:

$$G=\rho.A.\bar{v}=1.2\times 10^3\times 0.0142A=17.04A\ (g/S)$$

wherein ρ is the density of air.

From the absolute water content $x=7.6\times 10^{-3}$ (g/g), the water content W of the outflowing air is given by:

$$W = G\cdot x = 17.04\times 7.6\times 10^{-3}\times A = 0.1295A\ (g/S)$$
$$\approx 11189A\ (g/24\ \text{hr})$$

When the value W is greater than 0.12, there arises no problem. Now, assuming that the aspiretor hole has a diameter of 2 mm, $$A=\pi r^2=\tfrac{1}{4}\pi\times(0.002)^2=3.14\times 10^{-6}\ (m^2)$$

$$W=11189\times 3.14\times 10^{-6}=0.035\ (g/24\ \text{hr})$$

Because $4W=4\times 0.035=0.14>0.12$, at least 4 holes are necessary when the diameter is 2 mm. Further when the diameter is 3 mm or 4 mm, the water content W is 0.0788 (g/24 hr) or 0.14 (g/24 hr). Accordingly, there is a need to provide at least 2 holes with a diameter of 3 mm or at least one hole with a diameter of 4 mm. The present embodiment has four aspirator holes with a diameter of 3 mm, with allowance considered. To prevent insects, dust or the like from ingressing into the hood through the hole, it is desirable that the hole be provided with a filter, which nevertheless hampers the passage of water, so that care should be taken when the filter is to be provided.

A hood formed with four aspirator holes, 3 mm in diameter, was tested for the discharge of water through the holes under the same conditions as already mentioned by conducting usual refrigeration operation in the presence of 5 g of water as absorbed by a material, such as absorbent cotton, readily permitting evaporation of water. On the first day of the refrigeration operation, the outer surface of the outer plate 131 was fogged over an area indicated in a broken line in FIG. 11. On the fourth day, the fogged area diminished to the hatched areas shown in FIG. 11. The fog totally disappeared on the seventh day. This appears to indicate that the water evaporated at a rate of about 0.7 (g/24 hr)(without considering the amount of ingressing water). This rate corresponds to 0.175 (g/24 hr) per hole, which is higher than twice the aforementioned theoretical value and is in excess of the theoretical rate of ingress of water, 0.12 (g/24 hr). This indicates that the holes 150 achieve a fully satisfactory aspirator effect.

With reference to FIGS. 20 to 25, the mechine case 3 comprises an upper cover 7, end covers 5 and a base 6 and is in the form of a box. Provided in the machine case 3 are a first machine chamber P having accommodated therein a compressor 81, condenser 82, condenser blower 83, etc. which constitute a refrigeration cycle, as a refrigerator, and a second machine chamber Q formed by a heat insulating material, which is typically expanded styrol, and thereby thermally insulated from the first machine chamber P. The evaporator (cooler) 86 and an evaporator blower 87, as a cold air circulating blower, are accommodated in the second machine chamber Q. The second chamber Q has a cold air delivery opening 88 for delivering the air cooled by the evaporator 86 (i.e. cold air) to the air duct 4, and a return air intake opening 89 for drawing in the air (return air) used for cooling the commodity chamber 12. These openings 88, 89 are directed upward and formed side by side in a sidewise projecting portion of the chamber Q. The aforementioned water discharge tank 90 is provided in this chamber at a lower level. To make the machine case 3 not readily observable from outside, especially from the front of the display case G, the case 3 is disposed in the unused space S provided by the legs T.

For the installation of the machine case 3 in the space S which is generally not greater than 230 mm in height, the machine case 3 is made not higher than 230 mm. Since the first machine chamber P of the machine case 3 has an air intake 7A in the top wall of its upper cover 7, an air outlet 7B in the upper cover side wall and an air outlet 5B in the end cover 5, it is desirable that a clearance of at least about 30 mm be left above the case 3 as installed in the space S. Thus, the machine case 3 has a height of 200 mm.

Figure 20:
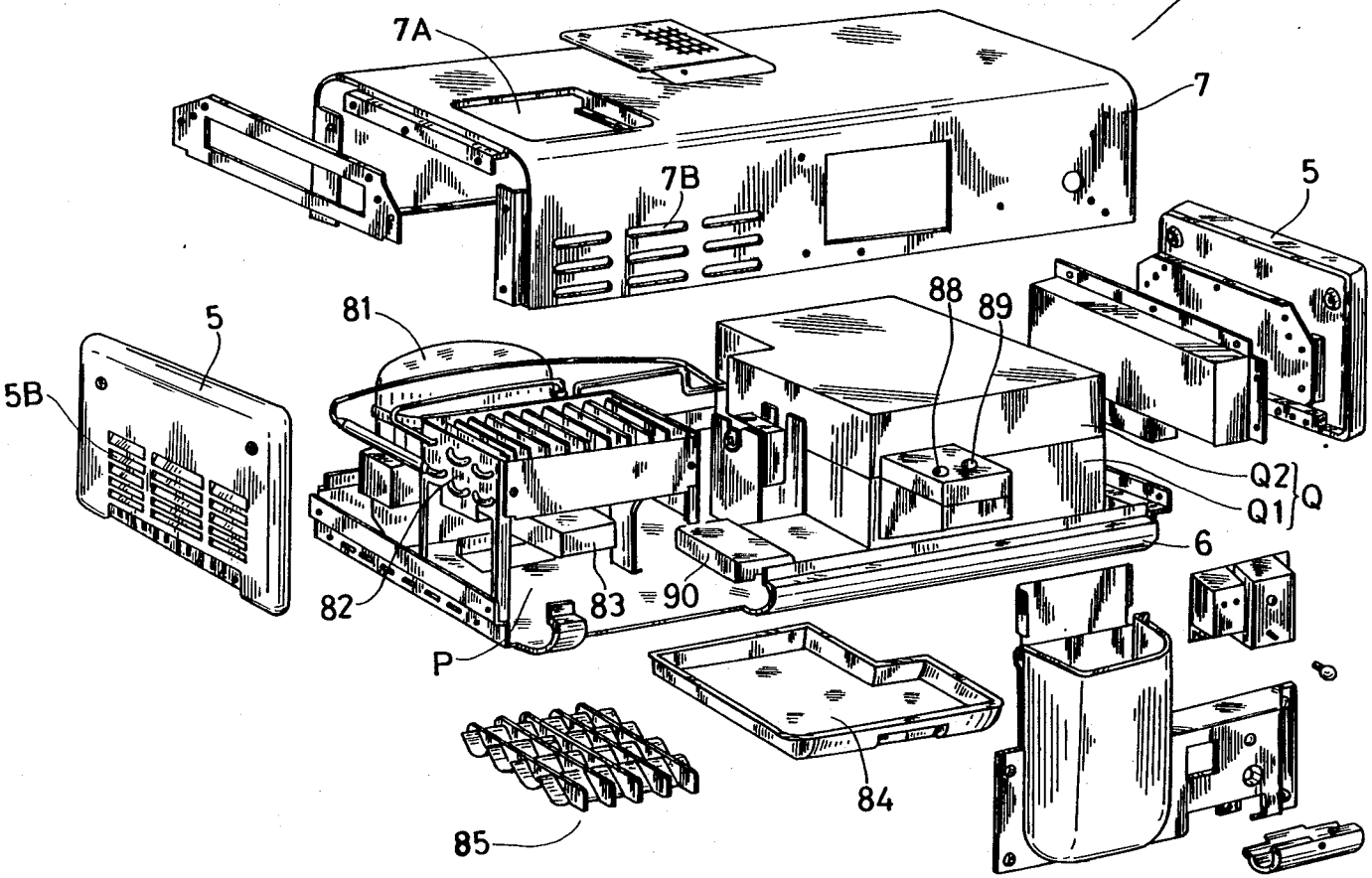
FIG. 20 is an exploded perspective view of a machine case.
Figure 21:
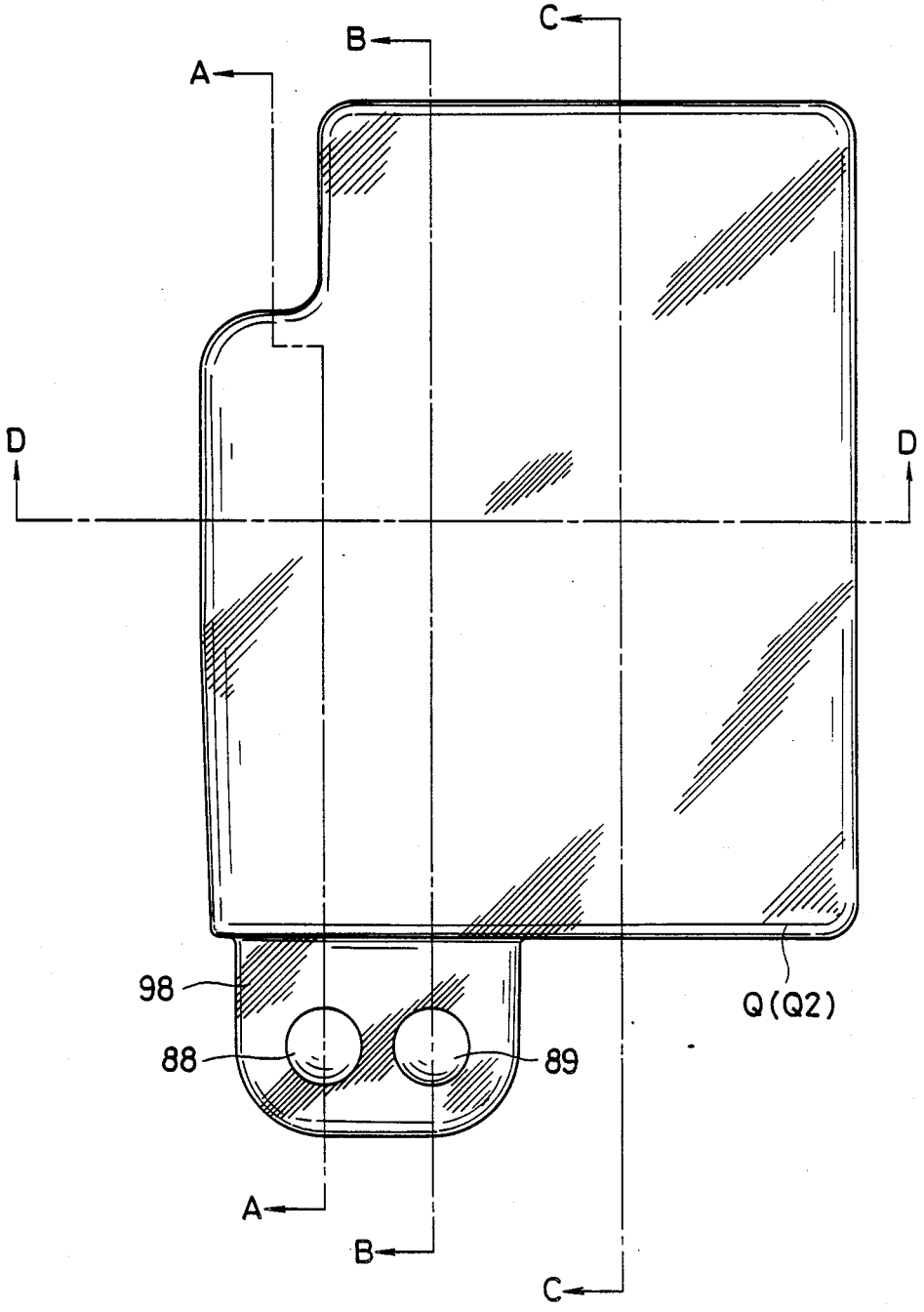
FIG. 21 is a plan view of a second machine chamber.
Figure 22:
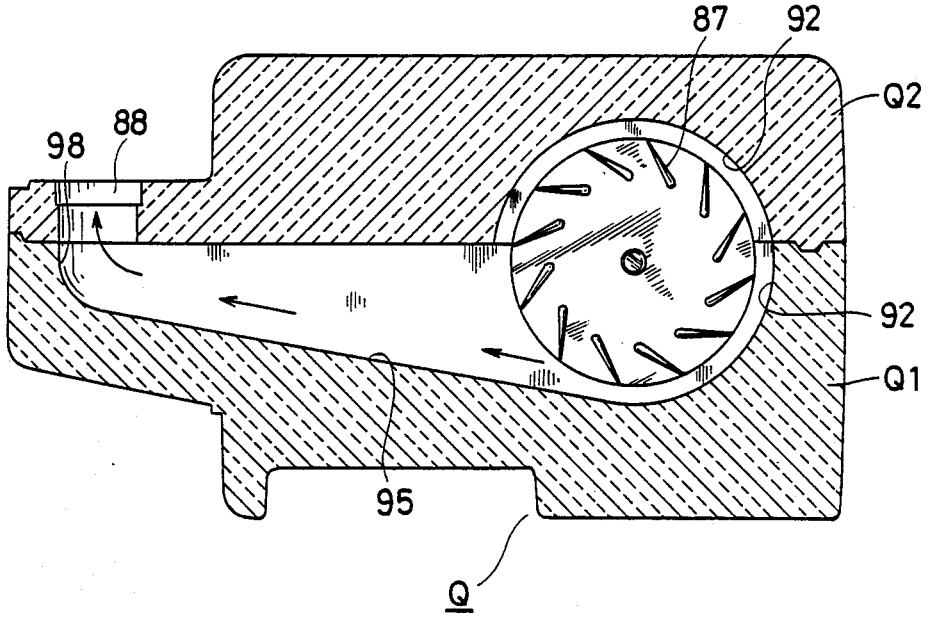
FIG. 22 is a view in section taken along the line A—A in FIG. 21.
Figure 23:
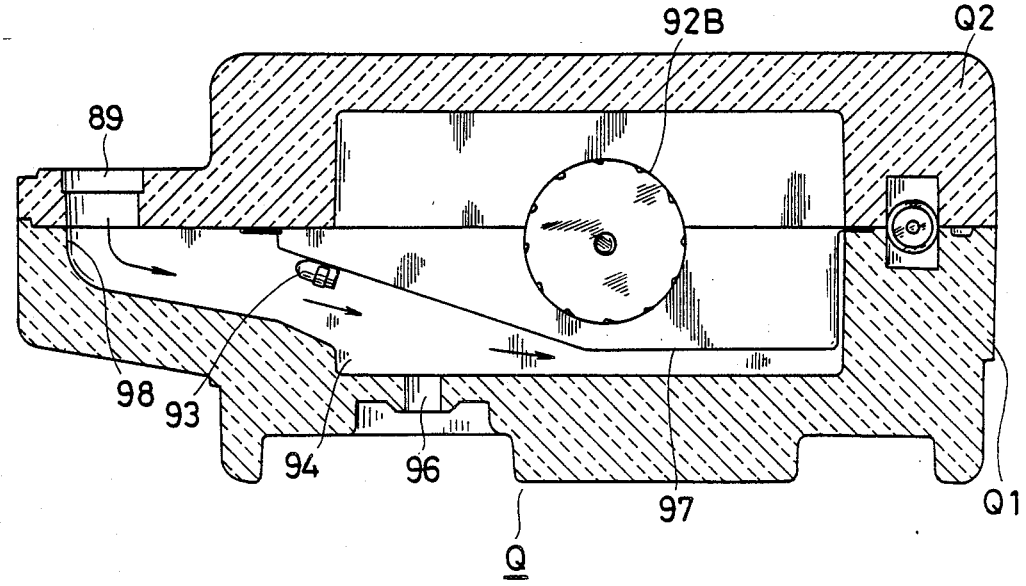
FIG. 23 is a view in section taken along the line B—B in FIG. 21.
Figure 24:
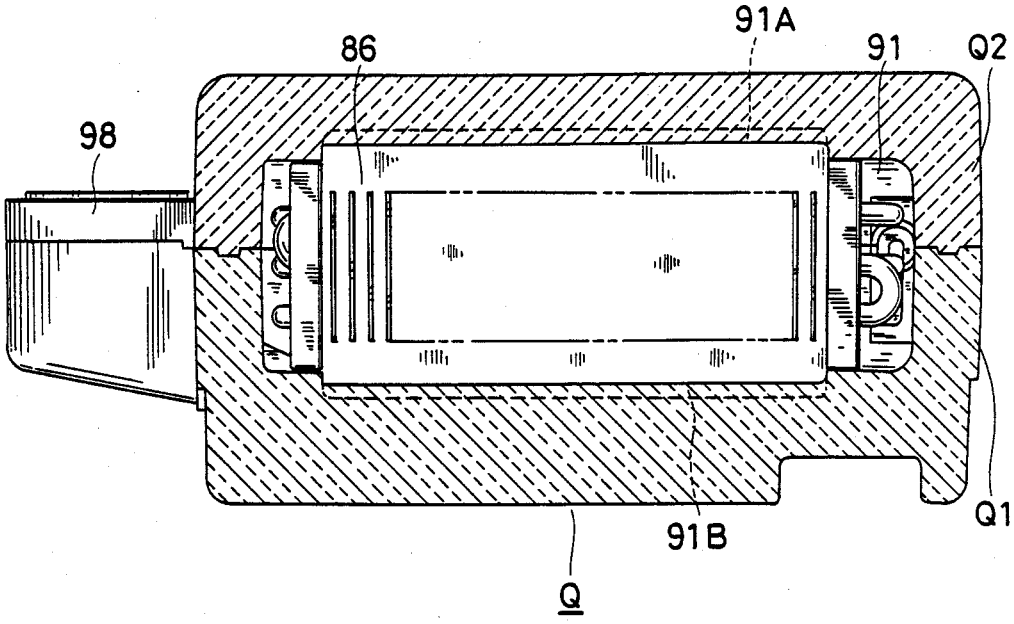
FIG. 24 is a view in section taken along the line C—C in FIG. 21.
Figure 25:
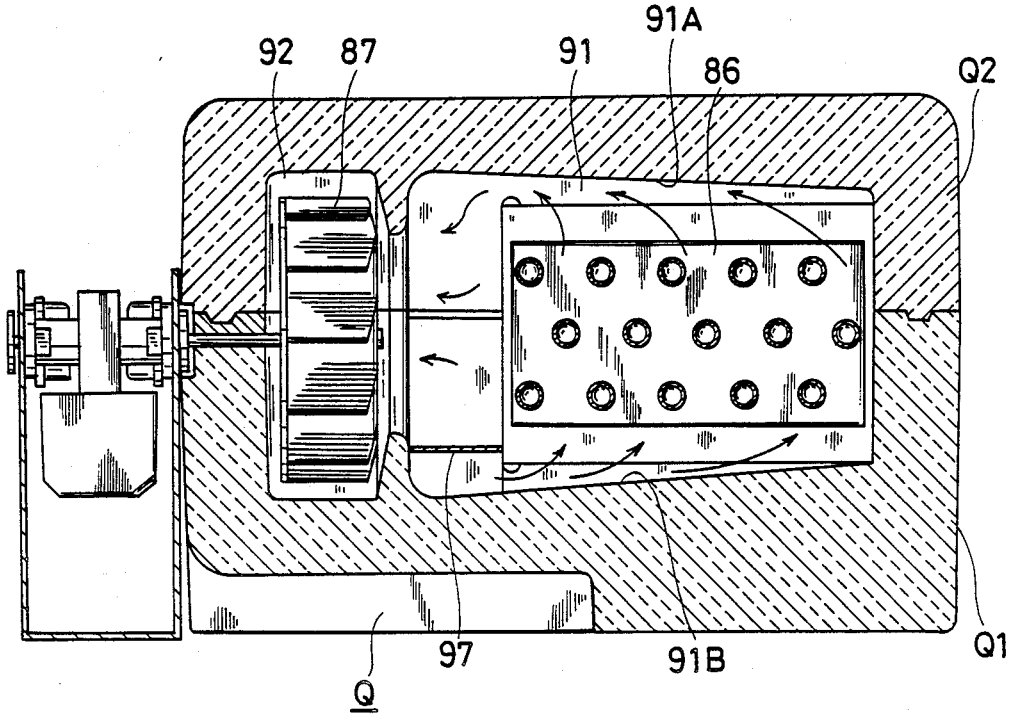
FIG. 25 is a view in section taken along the line D—D in FIG. 21.
Figure 26:
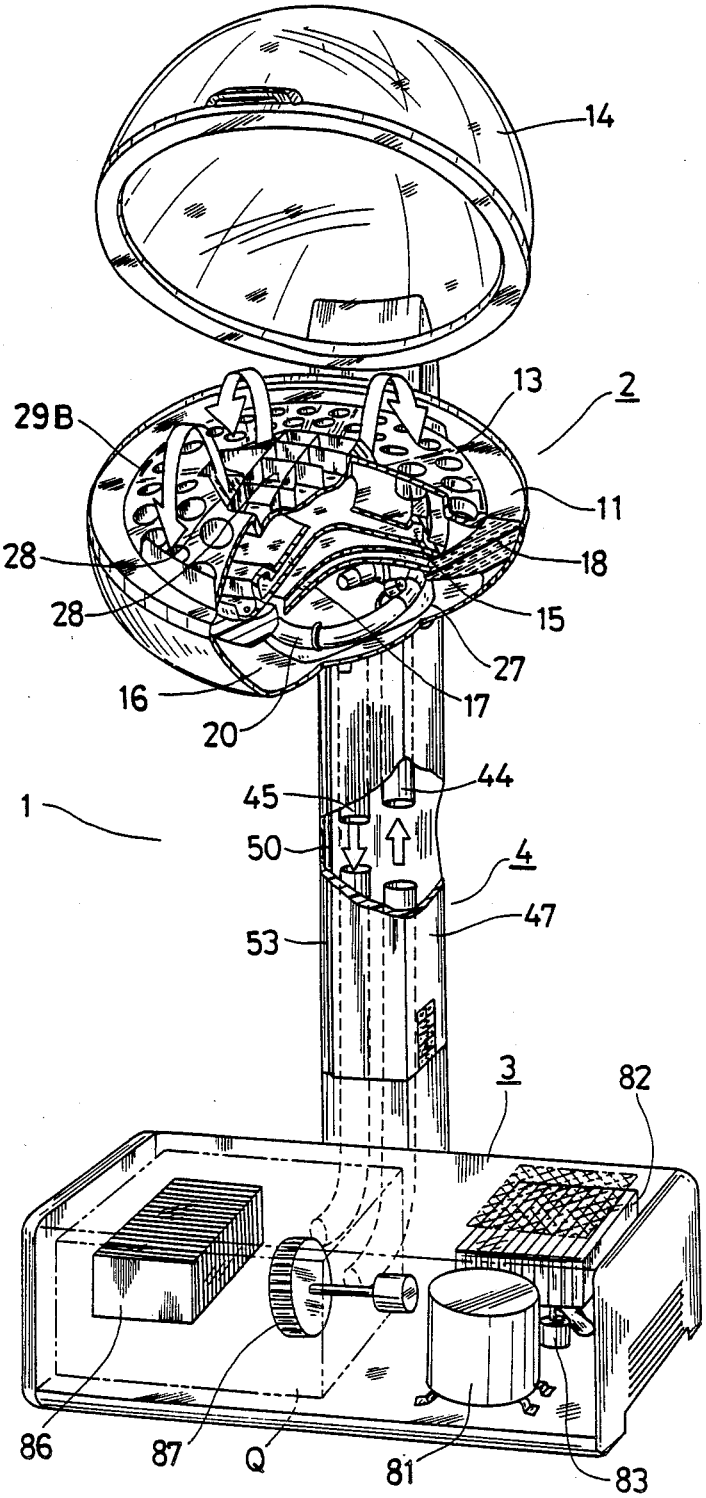
FIG. 26 is a perspective view schematically showing the overall construction of the display case device.
Figure 29:
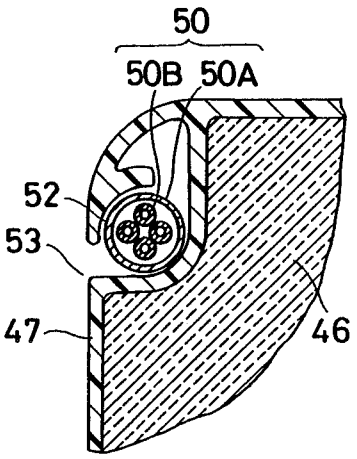
FIG. 29 is an enlarged view showing the portion indicated at F in FIG. 28.
Figure 28:
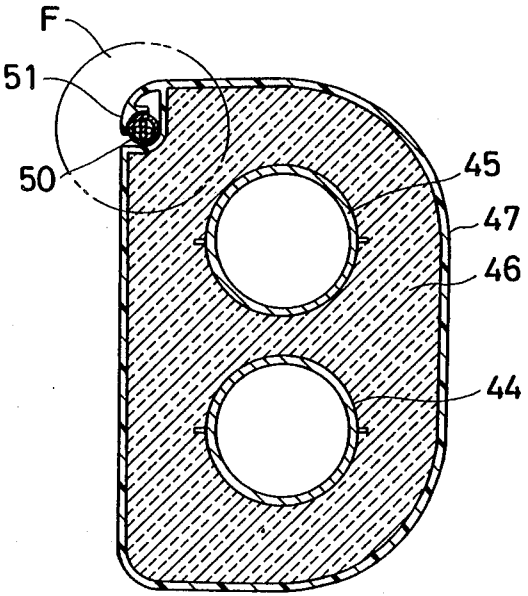
FIG. 28 is an enlarged view in section taken along the line E—E in FIG. 27.
Figure 27:
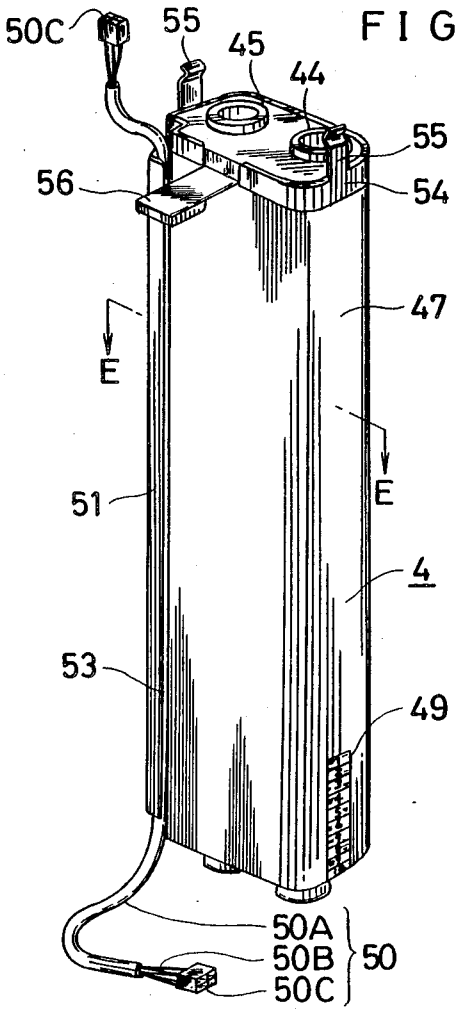
FIG. 27 is a perspective view of an air duct.
Figure 30:
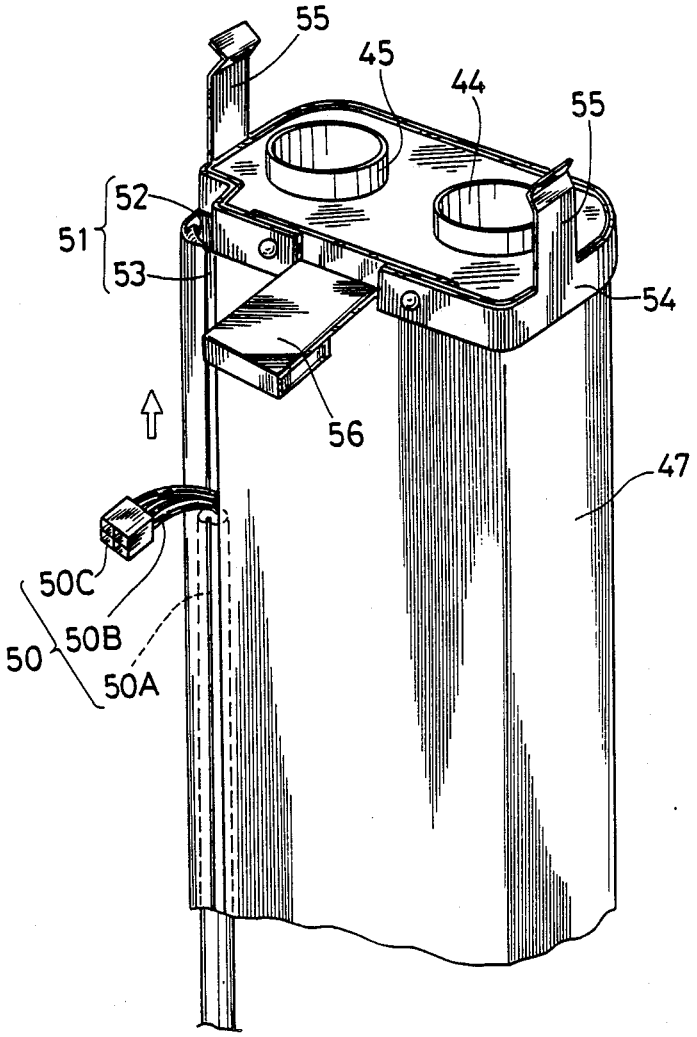
FIG. 30 is a fragmentary perspective view of the air duct.
Figure 31:
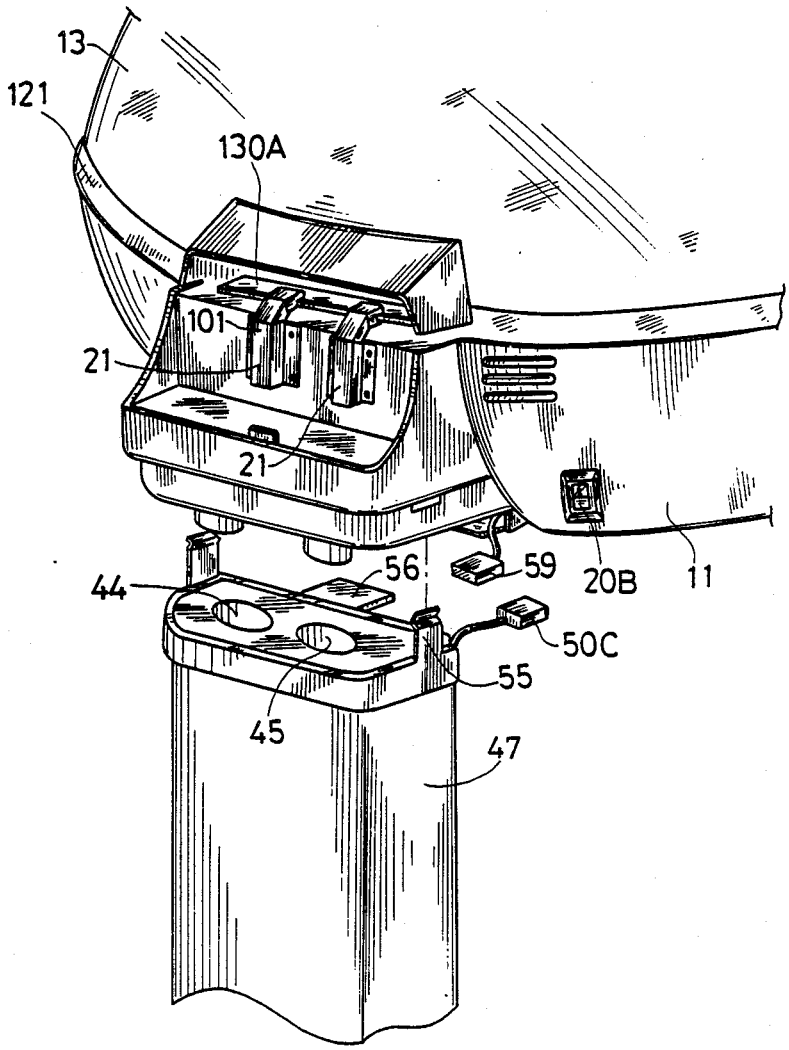
FIG. 31 is a perspective view for illustrating the air duct to be connected to the display case.
Figure 33:
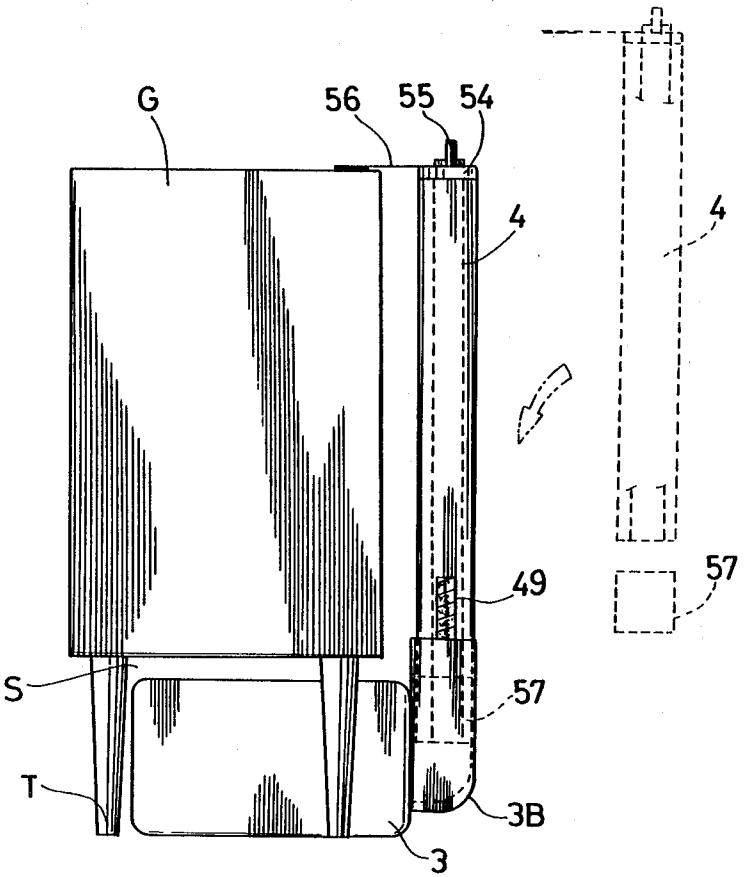
FIG. 33 is a side elevation showing the device in use.
Figure 32:
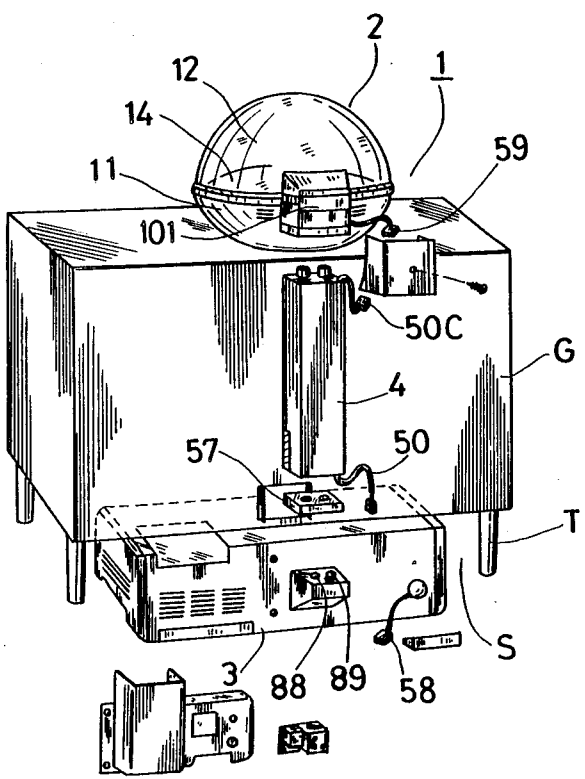
FIG. 32 is a partly exploded perspective view showing the refrigeration showcase.

With the height of the machine case 3 thus limited, the condenser 82 is disposed horizontally under the top wall air intake 7A of the first machine chamber P, with the condenser fins positioned vertically. The condenser blower 83 is disposed below the condenser, and the aforementioned evaporation tray, i.e. drain tray, 84 below the blower. Provided on the drain tray 84 is an evaporation promoting member 85 for drawing up the water collected in the tray to expose the water to air over an increased area and permit the water to evaporate easily. The evaporation promoting member 85 comprises strips of hydrophilic material (such as porous resin strips) in a latticelike arrangement when seen from above, wherein the strips are positioned upright and intersect one another at right angles (not shown), or in an arrangement wherein some of the strips are inclined and intersect the other strips which are upright as seen in FIG. 20. When the two arrangements were tested for the evaporation of water, the latter arrangement was about 20% greater than the former in the amount of evaporation. The promoting member of the latter arrangement further has the advantage that the air from the blower 83 is prevented from directly striking the surface of water, precluding an overflow that would occur if the surface becomes wavy. Furthermore, the air can be deflected by the inclined strips, and the member is more easily withdrawable along with the tray 84.

Figure 3C:
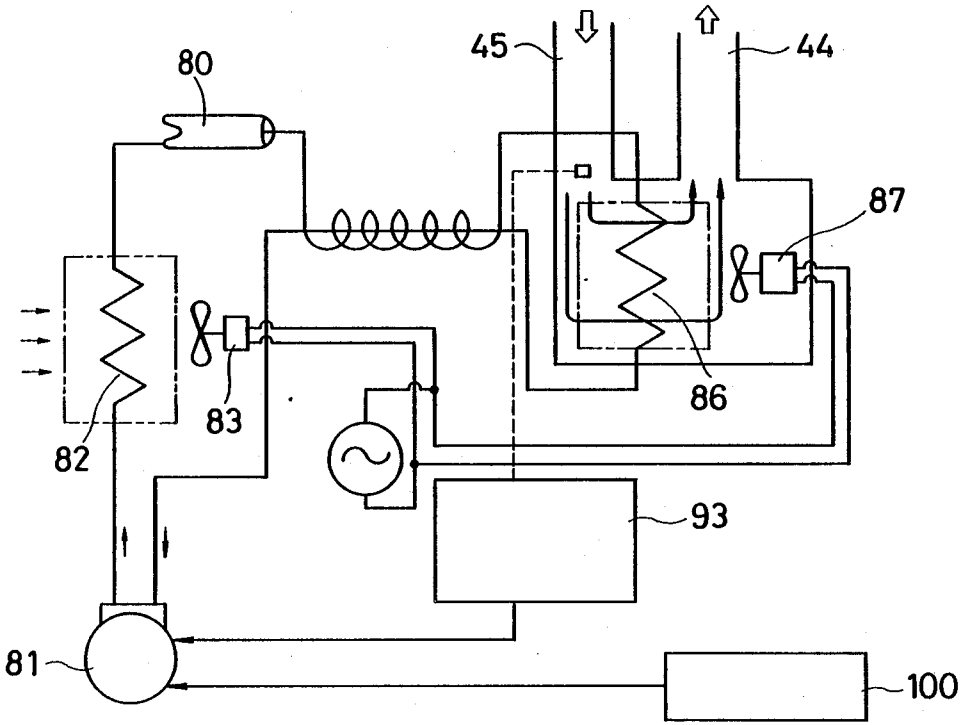
FIG. 3(C) is a diagram schematically showing a refrigeration cycle and an electric circuit as related thereto.

With reference to FIGS. 3(C) and 20, the boxlike second machine chamber Q is formed by a main wall member Q1 and a closure Q2 (heat insulating wall) which are made of a heat insulating material such as expanded styrol. The chamber Q has inside thereof the aforementioned heat exchanger portion 91 providing the evaporator 86 which is of the plate-fin type, a casing portion 92 communicating with the exchanger portion 91 and housing the evaporator blower 87, and temperature control means 93 disposed between an air inlet of the exchanger portion 91 and the return air intake opening 89. When a sensor detects a drop in the temperature of the return air below a specified level (e.g. 6° C.), the control means 93 discontinues the operation of the compressor 81, while the control means resumes the operation of the compressor 81 upon the temperature reaching a predetermined level (e.g. 9° C.). Thus the compressor 81 is on-off controlled by the means 93 to control the temperature of the commodity chamber 12. The chamber Q further has inside thereof an intake portion 94 slanting gradually downward from the return air intake opening 89 toward the air inlet for the passage of air, and a delivery portion 95 formed between an air outlet of the casing portion 92 and the cold air delivery opening 88 serving as an air channel, these portions 94 and 95 being formed integrally. The bottom surface 91B of the heat exchanger portion is rectangular, inclined gradually upward from its air inlet side toward the other side opposite thereto, and formed with a drain port 96 at a suitable location toward the lower side (at the position where the exchanger portion 91 laps over the intake portion 94 in the present embodiment) for discharging the water resulting from defrosting. To prevent cold air from flowing from the intake portion 94 directly into the casing portion 92, there is provided a partition member 97 for separating the intake portion 94 from the inlet opening 92B of the casing portion 92. Accordingly, the return cold air admitted into the heat exchanger portion 91 via the intake portion 94 is guided to below the evaporator 86 and then moved upward in contact with the evaporator 86 by being drawn by the blower 87. Since the bottom surface 91B of the exchanger portion 91 is inclined gradually upward from the inlet side toward the other side, the return air flows along the entire bottom surface of the evaporator 86 generally uniformly. (The air flows in a large amount at a lower velocity at the inlet side but in a smaller amount at a higher velocity at the other side, consequently forming a generally uniform flow.) The exchanger 86 therefore effects uniform heat exchange in its entirety for efficient refrigeration. The top surface 91A of the exchanger portion 91 is similarly inclined upward from the other side toward the outlet side. On the other hand, since the heat insulating material forming the second machine chamber Q integrally provides the heat exchanger portion 91, the casing portion 92 and other portions, the casing for the blower 87 and the tubular member providing the flow channel can be dispensed with and need not be connected together, while this structure achieves an improved heat insulating efficiency. It is also possible to project an elbow portion 98 sideways from the main wall member Q1 integrally therewith for deflecting the cold air being transported upward. The water discharge tank 90 is disposed under the drain port 96 for collecting defrosting water and conducting the water from the port 96 to the drain tray 84. The tank 90 has an inlet opening opposed to the drain port 96, a water trap and an outlet opening.

The condenser blower 83 and the evaporator blower 87 are held in continuous operation according to the invention irrespective of whether the evaporator 86 is operated along with the compressor 81 or stopped therewith and whether the evaporator 86 is defrosted by off-cycle operation for the following reason. The condenser blower 83 forwards air to the condenser 82 to effect heat exchange therewith and applies hot air, resulting from heat exchange, to the water collecting in the tray 84 for promoted evaporation, so that if the blower is stopped, failing to promote evaporation, water is likely to flow over the tray 84. On the other hand, the evaporator blower 87, which promotes heat exchange by the evaporator 86, also circulates the air cooled by the heat exchange through the display case 13, with the result that the blower 87, if stopped, fails to circulate the cold air, permitting the radiation of heat from outside to greatly raise the internal temperature of the commodity chamber only at the portion thereof around its outer periphery. Consequently the internal air temperature of the chamber is low in its center but high at the peripheral portion, hence a great difference and imbalance in air temperature. Further during refrigeration, the internal air temperature is about 6° C. and exceedingly higher than the temperature around the evaporator 86 and that of the evaporator 86 itself. Accordingly, if the evaporator 86 is defrosted utilizing the heat of air within the chamber by circulating the air, the defrosting time can be shorter than when off-cycle defrosting only is resorted to. With the present embodiment, defrosting operation is effected periodically by a timer 100, such that the operation cycle comprises refrigeration operation for 2 hours and 45 minutes, and defrosting operation for 15 minutes However, the use of the timer is not limitative; the evaporator 86 may be defrosted nonperiodically by the combination of a temperature sensor and defrosting control means. Indicated at 80 in FIG. 3(C) is a dehydrator.

With reference to FIGS. 26 to 33, the air duct 4 comprises a forward tube forward air channel 44 for forwarding the air cooled in the machine case 3 to the display case 2, the aforementioned return tube 45 return air channel for returning the air to the case 3 after cooling the commodity chamber 12, a heat insulating member 46 of expanded material for heat-insulating the two tubes 44, 45, and a duct cover 47 for covering the insulating member 46. The air duct 4 is removably connectable at its one end to the machine case 3 and at the other end to the display case 2. For the fluorescent lamp 20 provided in the display case 2 and the heater 27 therein for preventing condensation of water vapor in the illumination chamber 16 while the lamp 20 is off, several lead wires 50 extending from the machine case 3 need to be electrically connected to the display case 2. Preferably, these wires 50 are accommodated in the air duct 4 to avoid the possible break, whereas the wires 50, if enclosed along with the insulating member 46, can not be maintained and inspected, nor are they readily adjustable in length.

Accordingly, a wire casing 51 is formed in a portion of the duct other than the portion thereof packed with the heat insulating material. The casing 51 has a recess 52 formed in a corner of the duct cover 47 longitudinally thereof for accommodating the wires 50 as bundled, for example, in the form of a vinyl-sheathed cord, and a slit 53 having a width permitting the wires 50 to be inserted into the recess therethrough from one end of the recess toward the other end. The bundle 50A of lead wires 50 has at each end thereof an unsheathed portion 50B with a connector 50C attached thereto. The lead wires 50 can be placed into the casing 51 by inserting one end of the bundle 50A into the recess 52 at its one end, with the unsheathed position 50B projected outward through the slit 53, and guiding the unsheathed portion 50B along the slit 53 to the other end of the recess 52 by pulling the connector 50C on the projected unsheathed portion 50B. By this procedure, the wires 50 can be fitted into the casing 51 very easily and therefore efficiently without causing damage to the wires.

The duct cover 47 is provided at its upper end with an attaching member 54 for fixedly positioning the duct 4 in place when the duct 4 is to be connected to the display case 2. The attaching member 54 comprises a pair of upwardly extending hook pieces 55 engageable with the display case 2, and a horizontally extending engagement piece 56 engageable with the top of the display case G.

Display cases G useful for placing the display case 2 thereon are not uniform in height and are generally 860 mm to 960 mm in the height as measured from the floor to the top surface. In view of this, the air duct 4 is made adjustable in length over the range of about 100 mm in conformity with the variations (up to about 100 mm) in the height of display cases, when the duct 4 is to be connected to the machine case 3. For this purpose, the duct cover 47 is provided on one side of its lower portion with spacer selecting means, i.e., an adjustment scale 49 marked with the numerals, for example, of 1 to 10 as arranged downward at a spacing of 10 mm (see FIG. 27). When the engagement piece 56 of the attaching member 54 on the air duct 4 is temporarily placed on the top of a particular display case G, the upper end of a socket 3B of the machine case 3 points to a value ("5" in FIG. 33), which indicates the proper length adjusting spacer (duct portion) 57 to be selected (5-mm spacer in the present case). The indicated spacer is placed at the lower end of the duct 4. The spacer 57 is made of a heat insulating material such as Moltopren or expanded styrol and has openings corresponding to the respective forward tube 44 and return tube 45. With the present embodiment, different spacers which are different in thickness, i.e. 10, 20, 35 and 55 mm, are prepared for use in a suitable combination to make the length adjustable over the range of 10 mm to 110 mm.

Briefly described, the showcase 1 will be installed by the following procedure. First, the machine case 3 is placed in the unused space S under the display box G, with the socket (3B) side positioned on the rear side of the case S where the duct 4 is to be provided. The air duct 4 is then temporarily installed by placing the engagement piece 56 of the attaching member 54 on the top side of the display box G, with the duct lower end fitted in the socket 3B. An appropriate spacer 57 is then selected which corresponds in thickness to the value indicated by the upper end of the socket 3B on the adjustment scale 49 on the duct lower portion. The air duct 4 is joined to the cold air delivery opening portion 88 and the return air intake opening portion 89 of the machine case 3 with the spacer 57 provided therebetween to complete a forward air channel from the opening 88 to the forward tube 44 and an intake air channel from the return tube 45 to the opening 89, causing the machine case 3 to communicate with the display case 2 for the passage of air. Subsequently, the display case 2 is placed on the display box G while inserting the upper end of the air duct 4 into the air inlet-outlet portion of the display case 2 (i.e. the portion thereof under the hinge means 21) until the hook pieces 55 of the attachment member 54 come into engagement with the display case 2. Before or after this, the connectors 50C, 50C at the respective ends of the bundle of lead wires 50 fitted in the air duct 4 are attached to connectors 58, 59, respectively, of the machine case 3 and the display case 2.

The refrigeration showcase 1 has the following advantages.

(i) The commodity chamber provided in the upper portion of the display case for displaying commodities on sale is defined by an openable transparent member, so that the commodity chamber can be effectively exposed to the light illuminating the space wherein the display case is installed. The transparent member renders the commodities readily observable and very easy to place into or withdraw from the chamber. With the illuminating means disposed under the commodity chamber, there is nothing that will interfere with the sight when the commodities are observed.

(ii) The cavities for individually receiving the lower portions of the commodities on sale are formed in the upper side of the turntable in an orderly arrangement around the cold air outlet (preferably in tower form) extending upward from the bottom (turntable) of the commodity chamber approximately centrally thereof, so that the commodities can be arranged regularly and neatly around the cold air outlet with a clearance always formed between the commodities to serve as a passage for the cold air forced out from the cold air outlet. The cold air from the cold air outlet therefore smoothly flows to intake openings by being directed by the clearance, while the commodities can be exposed to an increased amount of cold air over a larger area and thereby refrigerated with an improved efficiency.

(iii) The turntable for placing commodities thereon is highest at its center and extends to a lower level outward from the center toward its periphery, with cold air outlets formed around the central portion and also with cold air intake openings formed outwardly of the commodity carrying portion. Consequently, the cold air outlets are at a higher level than the cold air intake openings, permitting the cold air to flow smoothly. The cold air flows from the center toward the periphery and therefore spreads uniformly throughout the entire commodity chamber to maintain the interior of the chamber at a uniform temperature with ease and good stability. The cold air forced out from the cold air outlets flows between the commodities before reaching the cold air intake openings, thereby exposing the commodities to an increase amount of cold air to achieve an improved refrigeration efficiency.

(iv) The machine case housing the mechanical components for refrigeration has a second machine chamber formed by a heat insulating material, having an evaporator and evaporator blower accommodated therein, and provided beside a first machine chamber housing the other mechanical components, with the result that the machine case can be given a reduced height. The second machine chamber has a cold air delivery opening and a return air intake opening which are formed side by side in an outwardly projecting portion and are directed upward. The opening portion is therefore connectable to the air duct easily. The first machine chamber has accommodated therein a condenser disposed horizontally under an air intake in its upper cover, a condenser blower below the condenser and a drain tray below this blower. This arrangement serves to decrease the height of the first chamber and permits the tray surface to be exposed efficiently to the air heated by the condenser. Because the drain tray is provided with an evaporation promoting member for drawing up the defrosting water collected therein and exposing the water to air over an increased area, the water in the tray can be evaporated efficiently and guided to an air outlet The second machine chamber has a heat exchanger portion, intake portion, casing portion and delivery portion which are integrally formed by a heat insulating material. This structure gives these portions improved heat insulating properties, further giving the chamber a reduced thickness and making the chamber compacter. The heat exchanger portion has an inclined bottom surface to admit air at the lower side thereof, so that the air flows uniformly along the inclined bottom surface from the lower side toward the higher side, enabling the evaporator to cool the air uniformly to attain an improved refrigeration efficiency.

On the other hand, the machine case thus adapted to have a diminished height can be placed in the unused spaces under display boxes for the effective utilization of the space which is usually left unused. A showcase of the separate type can be provided by using an air duct for causing the machine case to communicate with the display case for the passage of air. The display case can be made lightweight and is placeable on the display box with a smaller load acting on the display box than in the prior art. Further it becomes possible to use display cases of varying configurations and sizes for this type of device. Alternatively, the display case itself is usable singly as a display box.

(v) The transparent member (hood) comprises an inner plate, middle plate and outer plate each shaped three-dimensionally and positioned one over another in three layers with a space formed between the adjacent plates. An annular frame is provided at the lower ends of the inner and outer plates for each space to serve as an air layer. When the adjacent plates are so spaced apart suitably that convection of air will not readily occur in the air layer, the layer is serviceable as a heat insulating layer.

With water vapor ports or holes formed in suitable portions of the inner plate, the partial pressure of the space defined by the transparent member can be made to equilibrate with that of the air layer. The holes therefore act effectively to render the transparent member usable free from fogging or condensation of water vapor.

Since the transparent member defines a commodity chamber over the turntable, the commodities on the turntable can be viewed through the member very easily, while the air forced out into the chamber can be directed smoothly without stagnation. This makes it possible to maintain the interior of the chamber at a uniform temperature with ease.

(vi) When to be installed on display boxes which slightly differ from one another in height, the display case is not usable with good heat insulation in conformity with the differences if an air duct of definite length only is used. Nevertheless, a length adjusting spacer is joined to one end of the air duct for connecting the machine case to the display case, so that the display case can be installed on the display boxes of varying heights. Furthermore, the air duct is provided at its upper end with an engagement piece engageable with the display box and at its lower portion with spacer selecting means, such that when the air duct is temporarily attached to the display box by the piece, the position of the duct relative to the machine case enables the spacer selecting means to immediately specify the particular spacer to be used. Consequently, the length of the air duct is adjustable without using any measuring means such as a measuring tape.

(vii) The inner plate, the middle plate and the outer plate are spaced apart by such a distance (about 1 to about 10 mm if the plates are planar, or about 5 mm according to the present embodiment) that will not cause convection of air between the plates. The air layers between the plates can therefore be utilized as heat insulating layers. In view of the fact that the commodity chamber defined by the transparent member, when refrigerated, is maintained at a lower humidity than the ambient atmosphere, water vapor ports, about 2 mm to about 4 mm in diameter, are formed in the inner plate to cause water vapor to be released into the commodity chamber in an amount larger than the amount of water vapor penetrating into the transparent member. Consequently, the partial pressure of water vapor of the air between the inner plate and the middle plate is made to equilibrate with that of the air within the chamber through the ports for dehumidification, whereby the outer surface of the inner plate and the inner surface of the middle plate can be made free of condensation of water vapor.

On the other hand, the space defined by the outer plate and the middle plate is held in communication with the space defined by the inner plate and the middle plate and is thereby brought into equilibrium with the latter space in partial pressure of water vapor. As a result, the air in the two spaces is dehumidified through the water vapor ports formed in the inner plate to preclude condensation of water vapor on the inner plate outer surface, the middle plate surfaces and the outer plate inner surface, thereby obviating the likelihood that the condensate will impair the transparency of the transparent member, i.e., the display effect. The plates are made of transparent resin and therefore permeable to water, whereas when the middle plate is made thinner than the other plates, the water penetrating through the outer plate into the transparent member passes through the middle plate easily, accordingly flows through the water vapor ports into the commodity chamber readily and is less likely to remain inside the transparent member. This inhibits fogging of the transparent member and condensation of water vapor thereon.

(viii) The cold air supply portion of the air passage chamber has a cold air inlet at one side thereof and an opening located away from immediately below the center of the turntable toward the other side, whereby the cold air forced out from the air outlets in the turntable can be directed obliquely upward at a small angle with respect to the horizontal. Moreover, the cold air can be supplied in a larger amount through the outlets at the other side than through those in the central portion and at the above-mentioned one side. This diminishes the likelihood that the cold air will strike the transparent member especially at the top, thereby inhibiting fogging. Since the cold air inlet is not close to the opening, the cold air supply portion can be in a flat form to make the air passage chamber itself flat.

Figure 34:
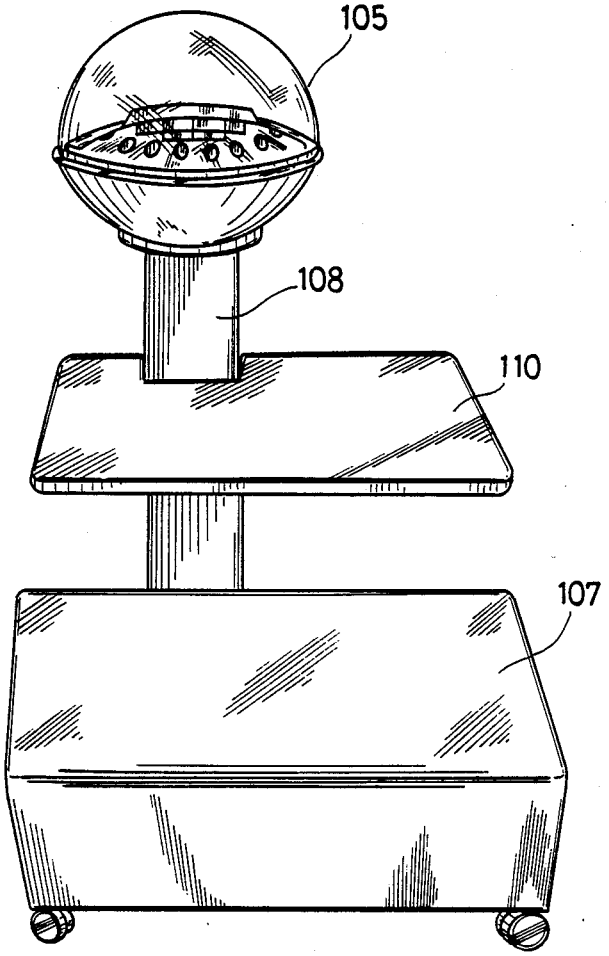
FIG. 34 is a perspective view showing another embodiment of the invention.

FIG. 34 shows another embodiment of the invention which comprises a foot portion 107, a support portion 108, a display case 105 and a shelf member 110 on the support portion 108 for placing articles thereon. The space formed between the display case 105 and the foot portion 107 can be effectively used for displaying or storing supplies of commodities for the display case and other commodities. The display case 105 has in its lower portion illuminating means 106, which can be adapted to illuminate through an opening the articles on the shelf member 110.

Figure 35:
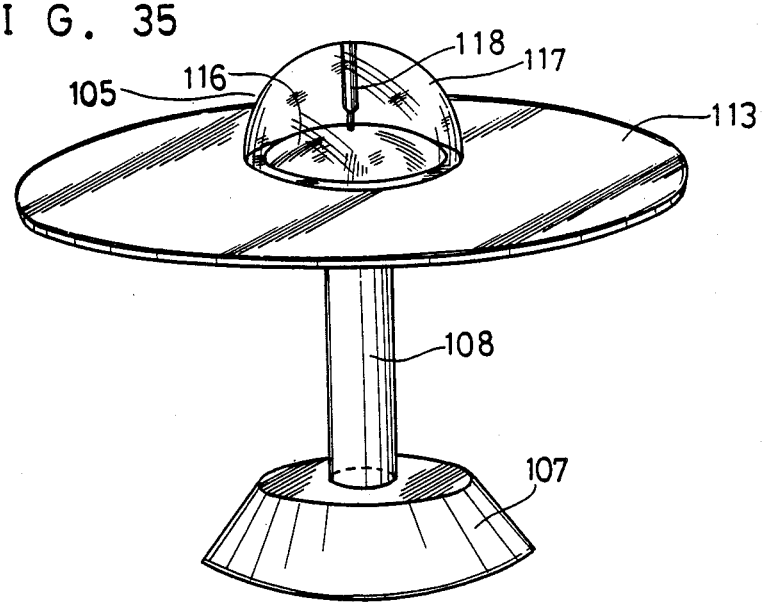
FIG. 35 is a view corresponding to FIG. 34 and showing another embodiment.
Figure 36:
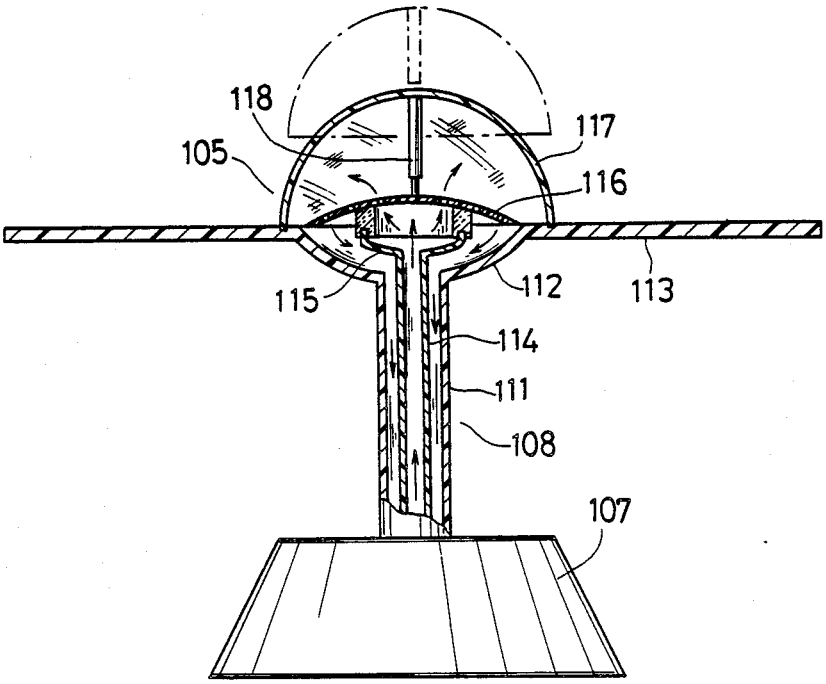
FIG. 36 is a fragmentary view in section showing the same.

FIGS. 35 and 36 show another embodiment, which is a showcase of the table type comprising a foot portion 107 and a support portion 108 extending upright from the foot portion 107 approximately centrally thereof. A support tube 111 providing the outer wall of the support portion has at its upper end a bowl-shaped air channel outer wall 112 and a horizontal circular table 113. An air duct 114 extending through the support tube 111 has an upper end which extends upward and radially outward to provide a release wall 115 having an opening of increased area. A turntable 116 is rotatably disposed above the release wall 115 and covered with a generally semispherical hood 117. The turntable 116 and the hood 117 form a display case 105 serving as a commodity chamber. The hood 117 is liftably connected to the turntable by lift means 118 such as gas spring.

The showcase of FIGS. 34 to 36 which are so constructed as above have the following advantages.

Each of these showcases comprises a foot portion, support portion and the display case, and the air duct for supplying cold air for cooling the display case is housed in the support portion. The foot portion includes a machine chamber having a compressor and other mechanical components accommodated therein. Accordingly, the device resembles a conventional simple display box in appearance, whereas the display case can be refrigerated.

Since the compressor and other components which are heavy are housed in the foot portion, the device serving as a display box can be installed with good stability with its center of gravity positioned at a low level. Because articles can be placed also on the upper surface of the foot portion, the device can be given higher stability when installed.

The shelf member attached to the support portion for placing articles thereon effectively utilizes the space between the display case and the foot portion (especially around the support portion for the device to carry an increased quantity of commodities. With the upper end of the support portion extending horizontally to provide a table portion around the display case, the display case is usable also as a table.

What is claimed is:

1. A refrigeration showcase comprising a display case for displaying commodities while refrigerating the commodities, a machine case disposed at a position away from the display case, and an air duct connecting the display case to the machine case in communication therewith, the display case comprising a display table for displaying the commodities as placed thereon, a cover member openably covering the display table from above to define a commodity chamber above the display table and permitting the commodity chamber to be seen therethrough from outside, and an air passage member disposed under the display table and providing a cold air supply portion for supplying cold air therethrough to the commodity chamber and a cold air discharge portion independent of the supply portion for discharging cold air from the commodity chamber therethrough, the machine case comprising a case body, a refrigerator housed in the case body and providing a refrigeration cycle comprising a compressor, condenser, pressure reducing means and evaporator, and a cold air circulating blower housed in the case body for supplying air cooled by the evaporator in circulation, the air duct having a forward air channel for transporting the cold air cooled by the evaporator therethrough to the cold air supply portion, and a return air channel independent of the forward air channel for transporting cold air from the cold air discharge portion to the evaporator therethrough.

2. A refrigeration showcase as defined in claim 1 wherein the air passage member has the cold air supply portion centrally thereof and the cold air discharge portion around the cold air supply portion.

3. A refrigeration showcase as defined in claim 2 wherein the cold air supply portion has a cold air inlet communicating with the forward air channel, and the cold air discharge portion has a cold air return outlet communicating with the return air channel, the cold air inlet and the cold air return outlet being positioned side by side adjacent to each other.

4. A refrigeration showcase as defined in claim 1 wherein the display case has an illuminating chamber below the air passage member for illuminating the interior of the commodity chamber from therebelow.

5. A refrigeration showcase as defined in claim 4 wherein a heat-insulating transparent member is interposed between the air passage member and the illuminating chamber.

6. A refrigeration showcase as defined in claim 4 wherein the illuminating chamber has a light source for emitting light, an outside air intake opening positioned below the light source for admitting outside air into the illuminating chamber therethrough, and an air release opening positioned above the light source for releasing air from inside the illuminating chamber to outside.

7. A refrigeration showcase as defined in claim 1 wherein the display table is provided with a cold air outlet approximately centrally thereof for forcing out the cold air supplied form the cold air supply portion into the commodity chamber and with cold air intake openings in the peripheral portion of the table for drawing cold air from the commodity chamber into the cold air discharge portion.

8. A refrigeration showcase as defined in claim 7 wherein the display table is formed with a plurality of cavities for stably supporting the commodities, and the cold air outlet is formed between the cavities.

9. A refrigeration showcase as defined in claim 7 wherein when the display table is supported on the air passage member, the cold air supply portion communicates with the cold air outlet, and the cold air discharge portion communicates with the cold air intake openings.

10. A refrigeration showcase as defined in claim 9 wherein the cold air supply portion is formed in its upper side with an opening at a position remoter from the cold air inlet and the cold air return outlet than the center of the display table.

11. A refrigeration showcase as defined in claim 7 wherein the display table is highest at its central portion and extends to a lower level gradually or stepwise from the central portion toward its periphery.

12. A refrigeration showcase as defined in claim 11 wherein the display table is a disk upwardly bulging to a spherical form at its central portion.

13. A refrigeration showcase as defined in claim 12 wherein the cover member rests on the peripheral portion of the air passage member, and the display table is supported by the air passage member and rotatable about the center of the disk.

14. A refrigeration showcase as defined in claim 1 wherein the machine case houses a condenser blower for forcibly cooling the condenser with air, and the case body has two machine chambers arranged side by side, one of the machine chambers having accommodated therein the compressor, the condenser and the condenser blower and being formed with an air intake in its top wall for admitting air from the condenser blower and an air outlet in its side wall for discharging the air forwarded from the condenser, the other machine chamber being formed by a heat insulating wall and having accommodated the evaporator and the cold air circulating blower therein, the heat insulating wall being formed with a cold air delivery opening for delivering cold air to the forward air channel and a return air intake opening for drawing in the cold air from the return air channel.

15. A refrigeration showcase as defined in claim 14 wherein the cold air delivery opening and the return air intake opening are formed is directed upward in a portion of the heat insulating wall.

16. A refrigeration showcase as defined in claim 14 wherein said one machine chamber has accommodated therein the condenser as disposed horizontally under the air intake in opposed relation thereto the condenser blower below the condensor and a drain tray under the blower for collecting the water released from the evaporator on defrosting, and an evaporation promoting member is interposed between the condenser blower and the drain tray for drawing up the water collected in the drain tray to increase the area of contact of the water with air.

17. A refrigeration showcase as defined in claim 1 wherein the return air channel of the air duct is in communication with the cold air discharge portion of the air passage member to conduct water condensate to the machine case along with the cold air from the discharge portion.

18. A refrigeration showcase as defined in claim 1 wherein the air duct is provided with an adjustable duct portion at end thereof for adjusting the overall length of the air duct.

19. A refrigeration showcase as defined in claim 18 wherein the air duct is provided at the connection between the duct and the display case with an engagement piece engageable with a display box for placing the display case thereon.

20. A refrigeration showcase comprising a display case for displaying commodities while refrigerating the commodities, and a machine case for supplying cold air to the display case in circulation, the display case comprising a display table for displaying the commodities as placed thereon, a cover member openably covering the display table from above to define a commodity chamber above the display table and permitting the commodity chamber to be seen therethrough from outside, and an air passage member disposed under the display table and providing a cold air supply portion for supplying cold air therethrough to the commodity chamber and a cold air discharge portion independent of the supply portion for discharging cold air from the commodity chamber therethrough, the cover member comprising a plurality of transparent plates, and an annular frame extending along the peripheral edges of the plates and supporting the plates as spaced apart from one another and positioned one above another.

21. A refrigeration showcase as defined in claim 20 wherein an inner plate of the cover member is formed with a small vent for aspirating the moisture from interior of the cover member to the commodity chamber.

22. A refrigeration showcase as defined in claim 20 wherein the plurality of transparent plates include an inner plate, an outer plate and a middle plate interposed between the inner and outer plates.

23. A refrigeration showcase as defined in claim 22 wherein the middle plate has a small hole for aspirating the space between the middle plate and the inner plate in communication with the space between the middle plate and the outer plate, and the inner plate had a small vent for aspirating the space between the middle plate and the inner plate in communication with the commodity chamber.

24. A refrigeration showcase comprising a display case for displaying commodities while refrigerating the commodities, and a machine case for supplying cold air to the display case in circulation, the display case comprising a display table for displaying the commodities as placed thereon, a cover member openably covering the display table from above to define a commodity chamber above the display table and permitting the interior of the commodity chamber to be seen therethrough from outside, and an air passage member disposed under the display table and providing a cold air supply portion for supplying cold air therethrough to the commodity chamber and a cold air discharge portion independently of the supply portion for discharging cold air from the commodity chamber therethrough, the air passage member having at its outer periphery a horizontal portion for openably placing the cover member thereon, the machine case comprising a case body, a refrigerator housed in the case body and comprising a compressor, condenser, pressure reducing means and evaporator to provide a refrigeration cycle, and a cold air circulating blower housed in the case body for supplying the air cooled by the evaporator to the commodity chamber via the cold air supply portion and subsequently returning the air from the commodity chamber to the evaporator via the cold air discharge portion.

* * * * *